US007126553B1

(12) United States Patent
Fink et al.

(10) Patent No.: US 7,126,553 B1
(45) Date of Patent: Oct. 24, 2006

(54) DEPLOYABLE ANTENNA

(75) Inventors: Patrick W. Fink, Fresno, TX (US); Justin A. Dobbins, Houston, TX (US); Greg Y. Lin, Houston, TX (US); Andrew W. Chu, Friendswood, TX (US); Robert C. Scully, League City, TX (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 314 days.

(21) Appl. No.: 10/679,688

(22) Filed: Oct. 2, 2003

(51) Int. Cl.
*H01Q 1/08* (2006.01)

(52) U.S. Cl. ..... 343/767; 343/881; 343/915

(58) Field of Classification Search ..... 343/878, 343/880, 915, 916, 881, 767
See application file for complete search history.

(56) References Cited

U.S. PATENT DOCUMENTS

| | | | | |
|---|---|---|---|---|
| 1,689,400 | A | 10/1928 | Manley | |
| 1,696,402 | A | 12/1928 | Horton | |
| 3,005,987 | A * | 10/1961 | Mack et al. | 343/872 |
| 3,587,105 | A | 6/1971 | Neilson | |
| 3,618,102 | A | 11/1971 | Dickason et al. | |
| 3,683,387 | A | 8/1972 | Meek | |
| 3,987,457 | A | 10/1976 | Moore | |
| 4,284,991 | A * | 8/1981 | Dupressoir | 343/725 |
| 4,400,701 | A * | 8/1983 | Dupressoir | 343/725 |
| 5,115,249 | A | 5/1992 | Homer | |
| 5,124,715 | A | 6/1992 | Homer | |
| 5,196,857 | A | 3/1993 | Chiappetta et al. | |
| 5,313,221 | A | 5/1994 | Denton, Jr. | |
| 5,430,451 | A | 7/1995 | Kawanishi et al. | |
| 5,515,564 | A | 5/1996 | Lyons | |
| 5,686,930 | A | 11/1997 | Brydon | |
| 5,712,645 | A | 1/1998 | Jellum et al. | |
| 5,771,022 | A | 6/1998 | Vaughan et al. | |
| 5,777,582 | A * | 7/1998 | Raab | 343/700 MS |
| 5,831,580 | A | 11/1998 | Taniguchi et al. | |
| 5,926,145 | A | 7/1999 | Honma | |
| 5,977,932 | A | 11/1999 | Robinson | |
| 6,054,955 | A | 4/2000 | Schlegel, Jr. et al. | |
| 6,111,549 | A | 8/2000 | Feller | |
| 6,211,841 | B1 | 4/2001 | Smith et al. | |
| 6,222,503 | B1 | 4/2001 | Gietema et al. | |
| 6,400,308 | B1 | 6/2002 | Bell et al. | |
| 6,421,012 | B1 | 7/2002 | Heckaman | |
| 6,429,819 | B1 | 8/2002 | Bishop et al. | |
| 6,437,749 | B1 | 8/2002 | Nagayama et al. | |
| 6,476,773 | B1 | 11/2002 | Palmer et al. | |
| 6,480,157 | B1 | 11/2002 | Palmer et al. | |
| 6,870,508 | B1 * | 3/2005 | Rivera | 343/709 |
| 2002/0015000 | A1 | 2/2002 | Reece et al. | |

FOREIGN PATENT DOCUMENTS

| | | |
|---|---|---|
| WO | WO 01/80362 A2 | 10/2001 |

* cited by examiner

*Primary Examiner*—Michael C. Wimer
(74) *Attorney, Agent, or Firm*—Theodore U. Ro

(57) ABSTRACT

A deployable antenna and method for using wherein the deployable antenna comprises a collapsible membrane having at least one radiating element for transmitting electromagnetic waves, receiving electromagnetic waves, or both.

65 Claims, 12 Drawing Sheets

DEPLOYABLE ANTENNA

GOVERNMENT INTERESTS

Origin of the Apparatus

The methods described herein were made by employee(s) under contract with the United States Government and may be manufactured and used by or for the Government of the United States of America for governmental purposes without the payment of any royalties thereon or therefore.

BACKGROUND

There exists a need for a deployable antenna for various applications. Considerations include weight, portability, stowage, cost, and ease of manufacturing. Ideally, such an antenna would have a simple structure, be easy to deploy for use, and be easy to collapse into a compact configuration for storage. Example applications for use include military operations, remote industrial operations, surveillance, scientific outposts, and general remote outdoor activities such as camping, hiking, fishing, and mountain climbing. A specific example of an application is the use of a stowable and deployable antenna in combination with a wireless communications system such as a cellular telephone or a cellular modem. As the use and popularity of wireless communication systems combined with the popularity of remote outdoor activities increases, the need for stowable and deployable antennas will also increase.

Mobile communication systems, for example cellular, personal communication systems, and wireless Ethernet provide wireless communications between a base station and at least one portable subscriber unit. Each mobile subscriber unit contains an antenna apparatus for the reception of the forward link signals and for the transmission of the reverse or return link signals. A typical mobile subscriber unit is a digital cellular telephone handset or a personal computer coupled to a wireless network. In urban areas, there usually exists a base station within the range of a mobile subscriber unit's built-in or stock antenna. However, in remote areas, the availability of such a base station within the range of a mobile subscriber unit's built-in or stock antenna may not exist.

In general, the performance of an antenna depends upon its configuration or shape as well as its size. Wireless communications devices are limited in their antenna performance due to a built-in or stock, omnidirectional antenna design. Therefore, increasing the performance of the built-in antenna for remote operations may increase the likelihood of communication between a mobile subscriber unit and a base station. As an example, it is well known in the field that increasing the antenna gain in a wireless communication system typically has beneficial effects on system performance.

The present invention seeks to provide an antenna that overcomes or reduces the aforementioned problems and takes into account the aforementioned considerations.

Description

DETAILED DESCRIPTION

Figure 1:
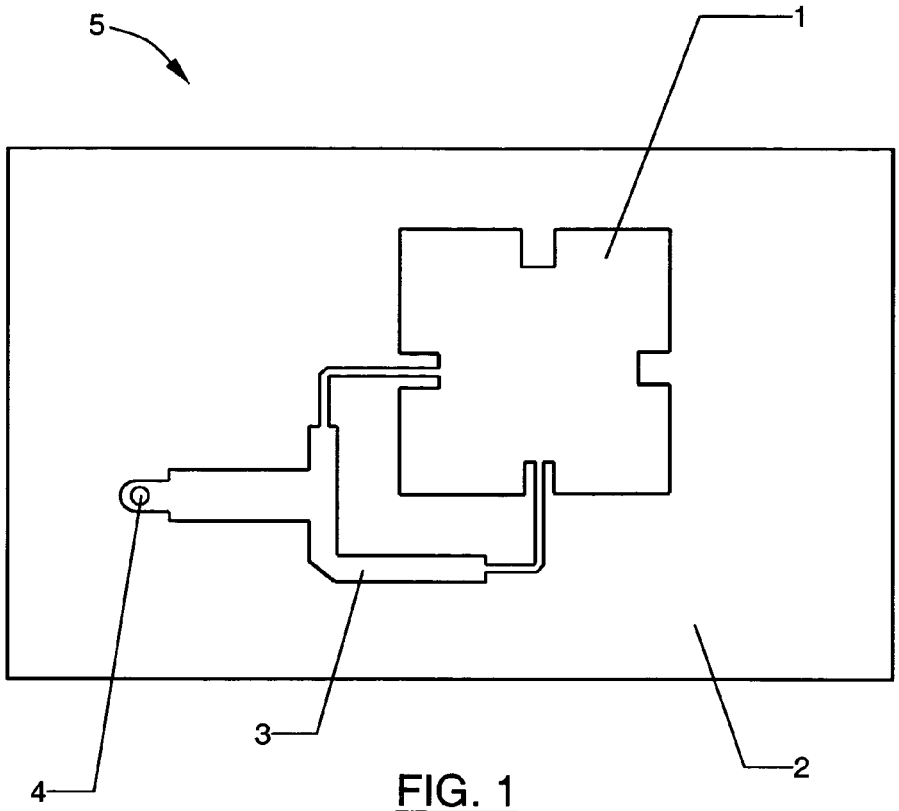
FIG. 1 (PRIOR ART)
FIG. 1. illustrates top view of a radiating element of the type commonly used in a patch or microstrip antenna.

The present invention will now be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete and will fully convey the scope of the invention to those skilled in the art. Like numbers refer to like elements throughout.

The word "about" as used herein may be applied to modify any quantitative representation that could permissibly vary without resulting in a change in the basic function to which it is related. For example, a quantitative temperature as disclosed herein may permissibly be different than the precise value if the basic function to which the temperature is related does not change. The word "generally" as used herein is used to indicate acceptable variance in a physical configuration so long as the variance doesn't change the basic function to which it is related. The word "radiate" or any form thereof for the purposes herein is defined as either transmitting electromagnetic waves, receiving electromagnetic waves, or both. The word "membrane" for the purposes herein is synonymous with the term "collapsible membrane." The word "slot" for the purposes herein is defined as an opening of rectilinear, ellipsoidal, asymmetric, or arbitrary shape, which defines a nonconductive region contained in a conductive surface. The word "ring" for the purposes herein is defined as an object of rectilinear, ellipsoidal, asymmetric, or arbitrary shape with a vacant center. The phrase "radiating element" as used herein is defined as a basic subdivision of an antenna that in itself is capable of radiating, although it does not necessarily imply the smallest such subdivision. A radiating element may be a radiating slot. The phrase "cavity antenna element" as used herein is defined as a radiating element that has a ground plane. The ground plane may be abbreviated so that it is not shared with other radiating elements, or it may be extended and shared with at least one radiating element either locally truncated or globally truncated. Examples of cavity antenna elements include, but are not restricted to the following: resonant antennas such as microstrip patch antennas, planar inverted-F antennas (PIFA), and cavity-backed slots, as well as certain traveling wave antennas such as cavity-backed spirals. The cavity antenna element comprises a ground plane boundary component and one or more of the following: at least one top boundary component and at least one side boundary component. The phrase "current antenna element" as used herein is defined as the set of radiating elements, which do not have or require a ground plane. Examples of current antenna elements include, but are not restricted to the following: conductive loops, dipoles, bowtie dipoles, slots, annular slots, and spirals. The phrase "boundary component" used in the context of a current antenna element is defined as the conductive pattern used to establish the functionality of that current antenna element. In a general context, the phrase "boundary component" is defined as a conductive pattern for either the cavity or current antenna elements to establish desired functionality over a predetermined band of operating frequencies. As an example, for resonant radiating elements (which may be of either cavity or current antenna types), the boundary component establishes resonances of the electric or magnetic (equivalent) currents or of the electric or magnetic fields at one or more predetermined operating frequencies. For the traveling wave type radiating elements, (which may be of either cavity or current antenna types), the at least one boundary component establish at least one guided wave that radiate in a predetermined manner as they travel away from the at least one feed point. The log-periodic and Archimedean spirals are examples of traveling wave antennas that are well documented in the literature. Furthermore, the phrase "parasitic element" as used herein is defined as a component of an antenna that is coupled electromagnetically; i.e, coupling to it is achieved without direct electrical connectivity. Since coupling occurs without direct electrical connectivity, at least one other component, in addition to the parasitic element, is required to form a complete radiating element. An example of an antenna with at least one driven element and at least one parasitic element is the Yagi-Uda antenna. Here, the phrase "driven element" is defined as a radiating element with electrical connectivity that may include a transmission line. It should be observed that the driven element individually may be referred to as a radiating element, and the collection, or set, of driven and parasitic elements may be referred to collectively as a single "radiating element." In addition to being employed to guide a traveling wave, parasitic elements may be used to implement amplitude taper in an array antenna. This may serve to provide reduced sidelobe levels as is well known to those experienced in the art. The term "array" or "array antenna" as used herein is defined to encompass a collection of at least one radiating element or subarray and may further comprise at least one parasitic element. The term "subarray" as used herein is defined as a smaller array which may be duplicated one or more times to form a larger array.

Figure 2:
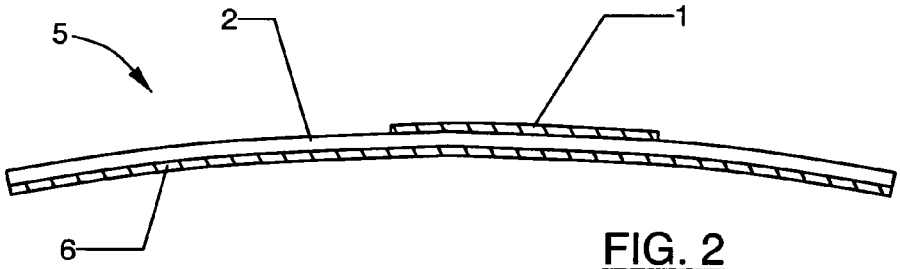
FIG. 2 (PRIOR ART)
FIG. 2. illustrates a cross sectional view of a radiating element of the type commonly used in a patch or microstrip antenna.
Figure 19:
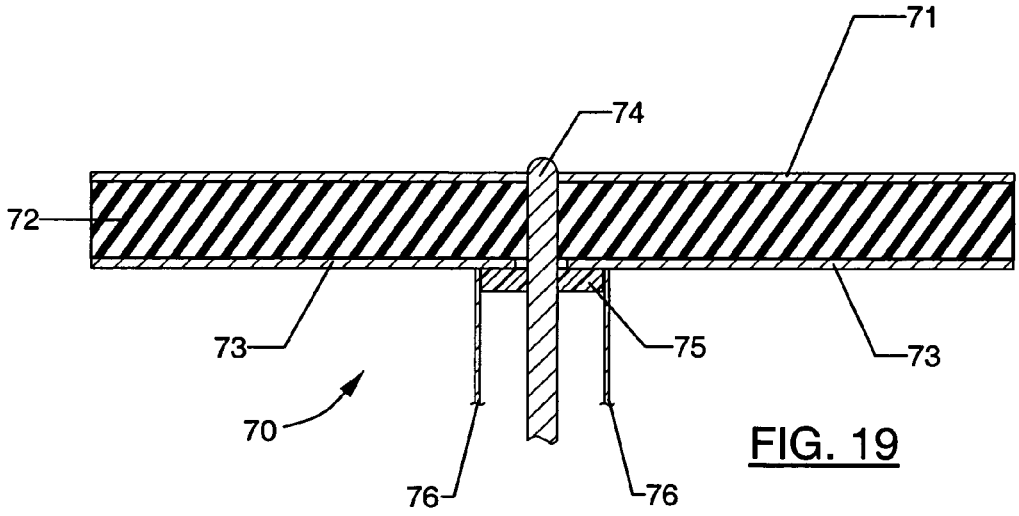
FIG. 19 illustrates, as an example, a cross-sectional view of a patch antenna.
Figure 20:
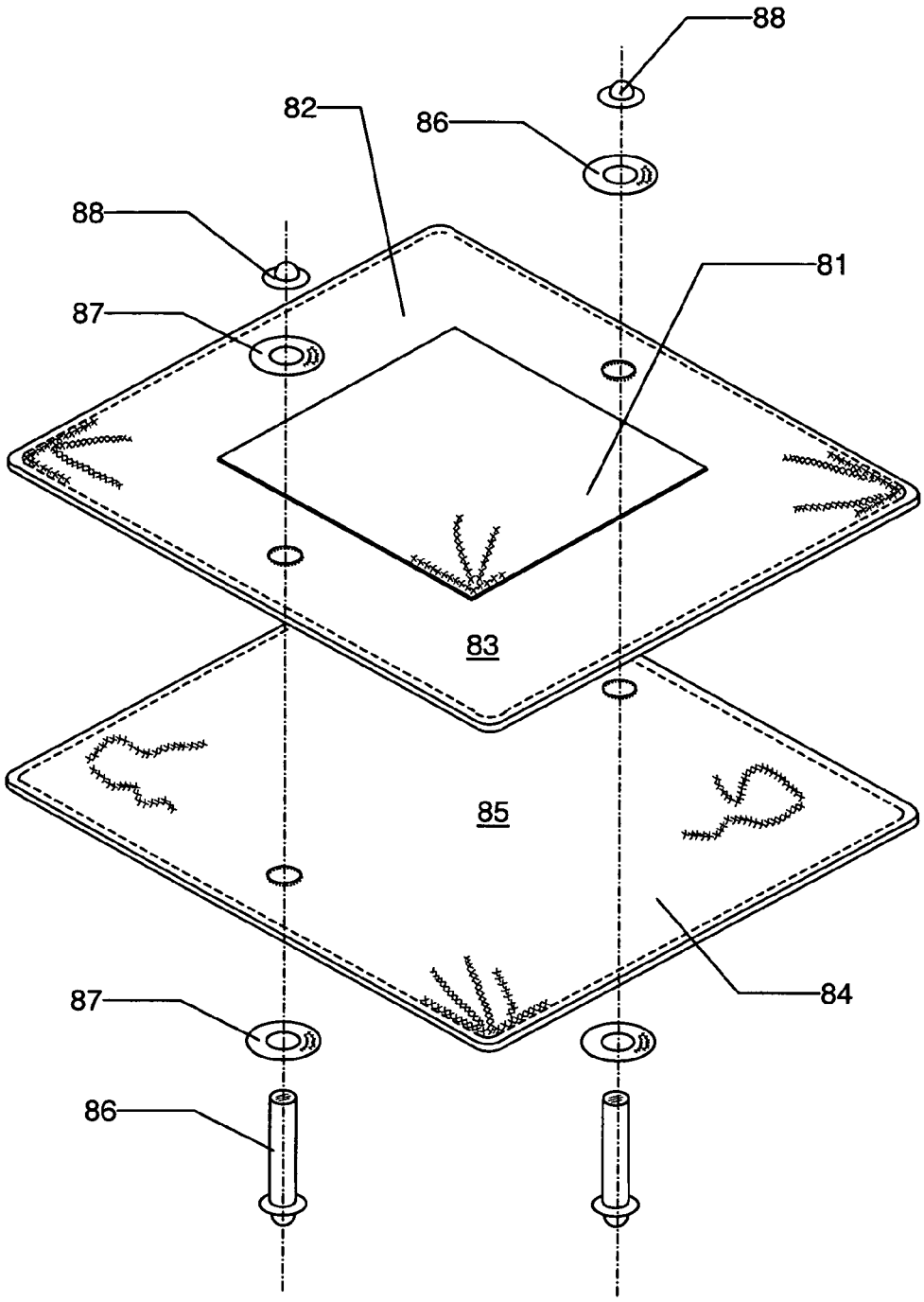
FIG. 20 illustrates, as an example, an exploded view of an embodiment of a deployable antenna that employs a patch antenna such as the one illustrated in FIG. 19.

Referring now to the drawings, and in particular to FIG. 1, there is shown a generally planar cavity antenna element 5 used in microstrip or patch antennas as are commonly known in the art. Microstrip or patch antennas are relatively flat and smooth and may be adapted for mounting on various surfaces without significantly increasing the overall profile. The cavity antenna element 5 as shown has a rectilinear shape and a microstrip feed network 3 through which signals are coupled from a node or port 4 to a top boundary component 1 of a cavity antenna element. The shape of the top boundary component may also be ellipsoidal, arbitrary, or asymmetric. The feed network 3 and top boundary component 1 are electrically connected to each other and printed on a dielectric substrate 2 through conventional printed circuit techniques known in the art. With continued reference to FIG. 1 and reference to FIG. 2, the dielectric substrate 2 serves to separate the top boundary component 1 and feed network 3 from a ground plane boundary component 6. Notches are illustrated in FIG. 1 as part of the top boundary component 1 as an example of one embodiment for the top boundary component 1. However, all known conventional shapes and designs for top boundary components may be utilized. FIG. 2 also illustrates the low profile and flexibility of the cavity antenna element 5. Another embodiment of a cavity antenna element incorporated into an antenna 70 is illustrated in FIG. 19. In this embodiment, a top boundary component 71 is formed of a conductive fabric. Further, a strip feed probe 74 and ground plane boundary component 73 are also formed of a conductive fabric. The strip feed probe 74 is electrically connected to the top boundary component 71. An insulating grommet 75 is used to help separate the ground plane boundary component 73 from the strip feed probe 74. A dielectric substrate 72 separates the top boundary component 71 from the ground plane boundary component 73. An outer conductor 76 concentrically surrounds the strip feed probe 74 and is electrically connected to the ground plane boundary component 73. The outer conductor 76 serves as a ground line. Both the outer conductor 76 and strip feed probe 74 may be connected to an antenna interface adapter (not shown), which is discussed later. FIG. 20 illustrates, as an example, a perspective view of an embodiment of a collapsible membrane 82 and a deployable cavity antenna element that incorporates a top boundary component 81. In this embodiment, the top boundary component 81 is attached to a collapsible membrane 82 formed of a nonconductive fabric 83. Further, in this embodiment, a collapsible ground plane boundary component 84 is illustrated wherein the ground plane boundary component 84 is formed of a conductive fabric 85. A single layer or multiple layers of conductive fabric for the deployable ground plane boundary component 84 may be employed. In addition, in this embodiment, fasteners, which are comprised of spacers 86, grommets 87, and caps 88 are used to attach the deployable ground plane component 84 to the collapsible membrane 82.

Figure 18:
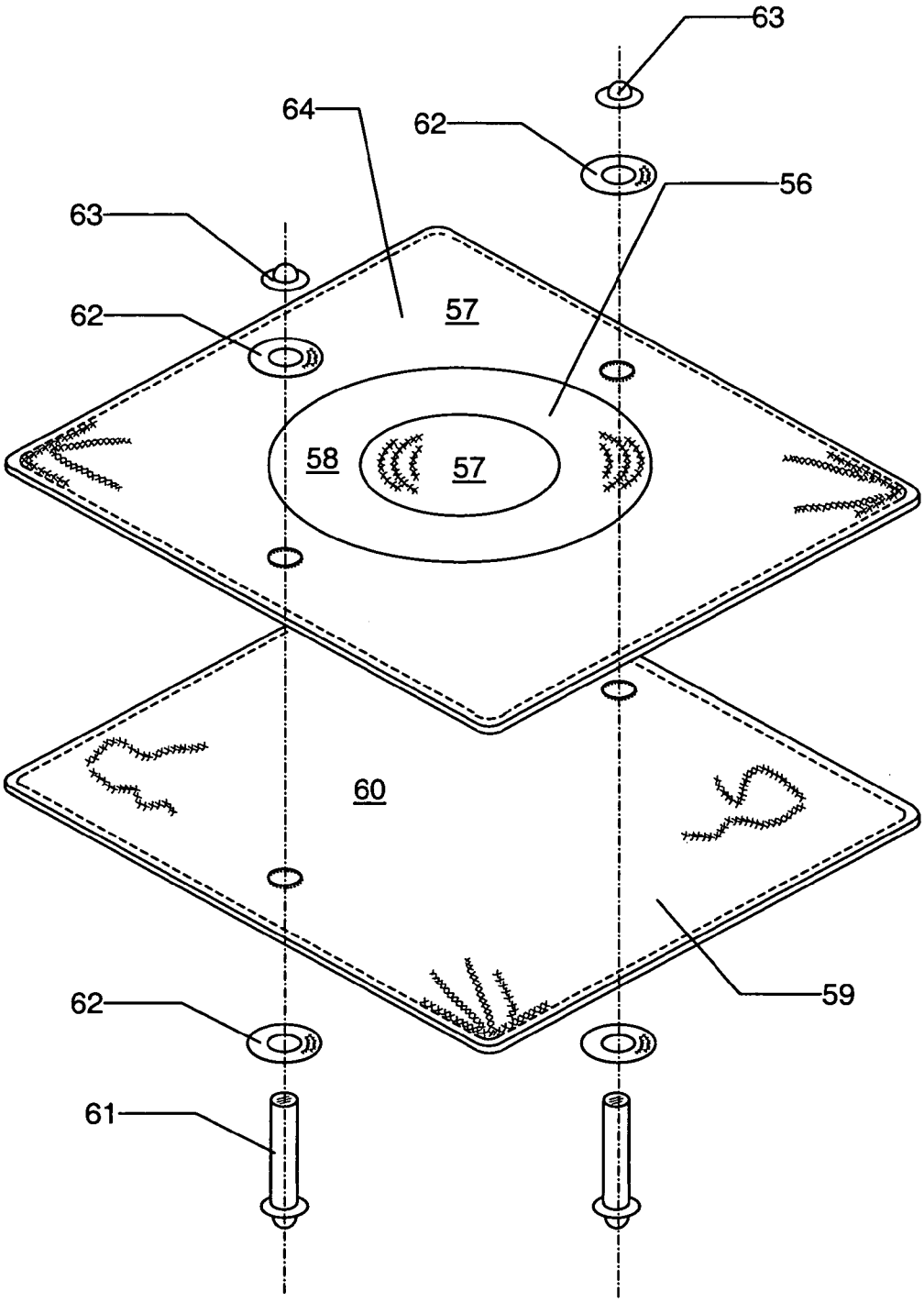
FIG. 18. illustrates, as an example, an exploded view of an embodiment of a deployable antenna that employs a radiating annular slot.

As stated above, multiple embodiments exist for the boundary components of both cavity and current antenna elements. For example, multiple embodiments exist wherein the boundary components are formed from conductive material. In one embodiment, the boundary components may be formed from a conductive metal or alloy. In a second embodiment, the boundary components may be formed from conductive fabrics. In additional embodiments, some boundary components are formed from a conductive metal or alloy, while others are formed from conductive fabrics. Multiple embodiments for shapes and configurations also exist for the boundary components. In one embodiment, the boundary components may have a planar shape with multiple configurations (e.g., dipole, bow-tie, spiral). Wherein the boundary components have a general planar shape in one embodiment, as stated above, the boundary components may have a generally rectilinear, ellipsoidal, arbitrary, or asymmetrical shape In a second embodiment, the boundary components of the radiating elements, either cavity or current type, has at least one slot in a general rectilinear, ellipsoidal, arbitrary, asymmetrical, "Vivaldi", or "volcano" (as is known in the art) shape. Multiple embodiments exist wherein the radiating element is a radiating slot formed from at least one slot in a conductive material. This type of element is related to the embodiments defined above in a sense as described by Babinet's Principle. For example, in one embodiment, each slot may be cut out of conductive material such as conductive fabric. FIG. 18 illustrates an embodiment of a collapsible membrane 64 and a cavity antenna element that employs a radiating annular slot 56 cut out of a first conductive fabric 57. The radiating annular slot in this embodiment can be considered a top boundary component. The collapsible membrane 64 in this embodiment has two layers wherein the top layer is the first conductive fabric 57. A nonconductive fabric 58 is the second layer of the collapsible membrane. Further, in this embodiment, a ground plane boundary component 59 is illustrated wherein the ground plane boundary component 59 is formed of a second conductive fabric 60. A single layer or multiple layers for the ground plane boundary component 59 may be employed. In addition, in this embodiment, fasteners, which are formed of spacers 61, grommets 62, and caps 63 are used to attach the ground plane boundary component 59 to the collapsible membrane 64. The collapsible membrane 64 may be formed of at least one layer of conductive material attached to at least one layer of nonconductive material wherein at least one radiating slot is cut out of the at least one layer of conductive material. The use of multiple layers of conductive and nonconductive material as well as multiple radiating slots may be employed for a layered antenna design. In a second embodiment, each slot may be introduced in a weaving pattern (not shown). In a third embodiment, each slot may be formed between embroidered conducting regions in the conductive material (not shown). In a fourth embodiment, each slot may be introduced in a knitting pattern (not shown). A current element results if the ground plane boundary component 59 shown in FIG. 18 is removed. In another embodiment, a reflector is placed at about one-quarter wavelength from the plane of the top boundary component. In this form, the current element is indistinguishable from the cavity element of FIG. 18. The input impedance of the current element is little affected by the reflector when the latter is placed at this particular distance. The radiation pattern, however, is more concentrated in one hemisphere compared to the current element without the reflector. A reflector as used herein is defined as a conductive surface, which is generally parallel to each radiating element, array antenna, or subarray and spaced at a predetermined distance from each radiating element, array antenna, or subarray. Multiple predetermined distances exist. For example, in one embodiment the predetermined distance from each radiating element, array antenna, or subarray to the reflector is one-quarter wavelength.

Figure 3:
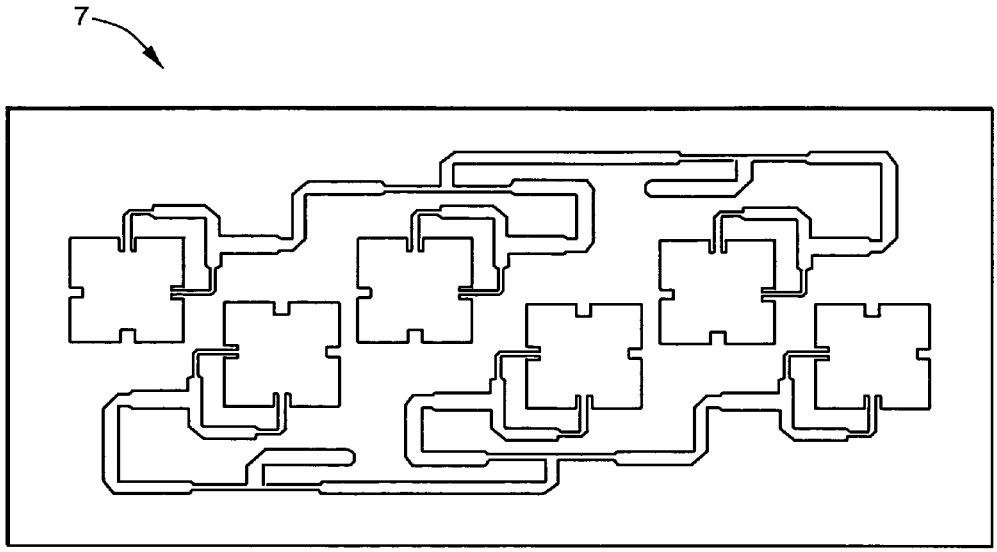
FIG. 3 (PRIOR ART)
FIG. 3. illustrates a top view of a subarray comprised of a plurality of radiating elements of the type commonly used in a patch or microstrip antenna.
Figure 4:
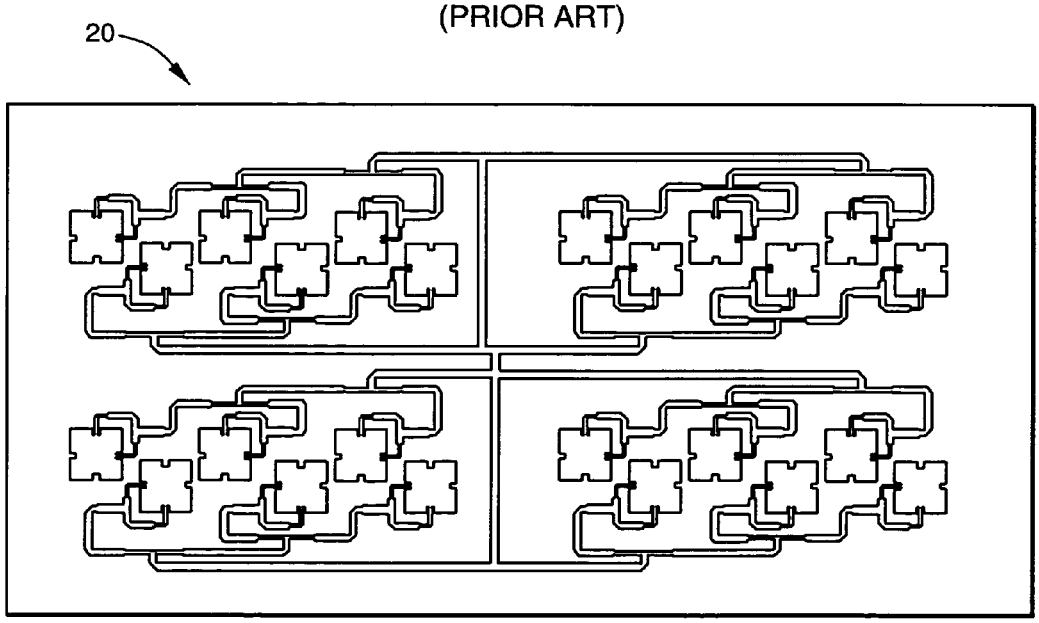
FIG. 4 (PRIOR ART)
FIG. 4. illustrates an embodiment of a plurality of subarrays electrically interconnected via appropriate transmission lines to form an array antenna.

Referring now to FIG. 3, there is shown how a plurality of radiating elements may be electrically interconnected via appropriate transmission lines to form a subarray 7, as is commonly known in the art. Referring now to FIG. 4, there is shown how a plurality of subarrays may be electrically interconnected via appropriate transmission lines to form an array antenna 20.

Figure 5:
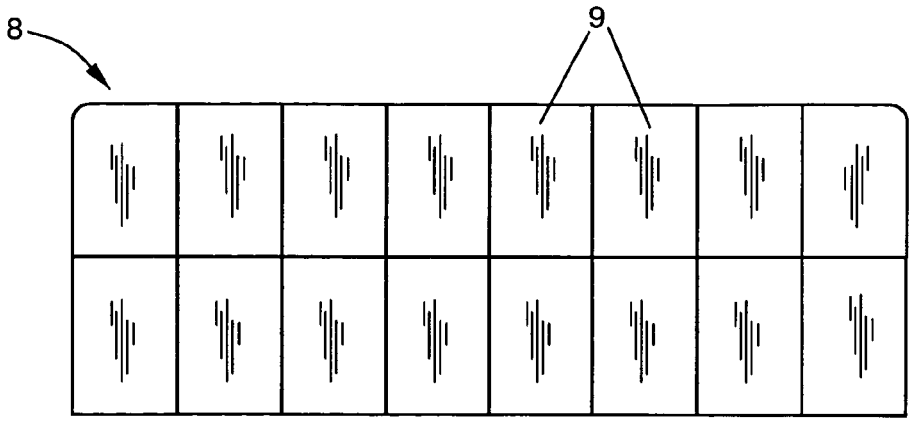
FIG. 5 (PRIOR ART)
FIG. 5. illustrates a top view of a generally rectilinear deployable structure formed of a plurality of sections.
Figure 6:
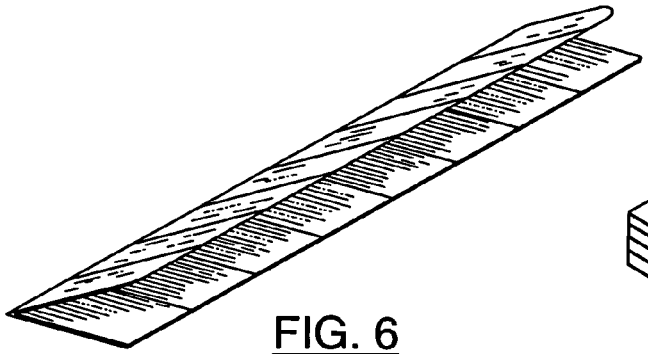
FIG. 6 (PRIOR ART)
FIG. 6. illustrates a perspective view of a semi-folded configuration for a generally rectilinear deployable structure formed of a plurality of sections.
Figure 7:
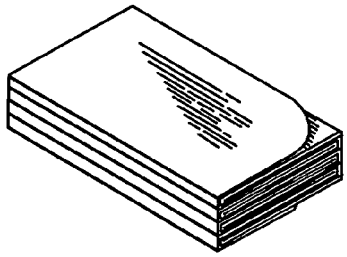
FIG. 7 (PRIOR ART)
FIG. 7. illustrates a perspective view of a folded configuration for a generally rectilinear deployable structure formed of a plurality of sections.

Referring now to FIG. 5, FIG. 6, and FIG. 7, there is shown an example of a first embodiment for collapsing a structure into a reduced volume (ref: FIG. 7). This particular example is one embodiment of an automobile sunshade, commonly known in the art. In this embodiment, a structure 8 is divided into a plurality of sections 9. In this particular example, the structure 8 is formed of a corrugated cardboard material. However, a variety of other materials can be used in the general structure and method for collapsing into a reduced volume. For example, in one embodiment, the flexible material may be formed of a deformable, nonconductive material or fabric. In a second embodiment, the flexible material may be formed of a deformable, conductive material or fabric. In a third embodiment, the flexible material may be formed from multiple layers of deformable, conductive material; multiple layers of deformable, nonconductive material; or both. Thus, the general structure and method of collapsing as illustrated in FIG. 5, FIG. 6, and FIG. 7 may be utilized for a deployable antenna.

Figure 8:
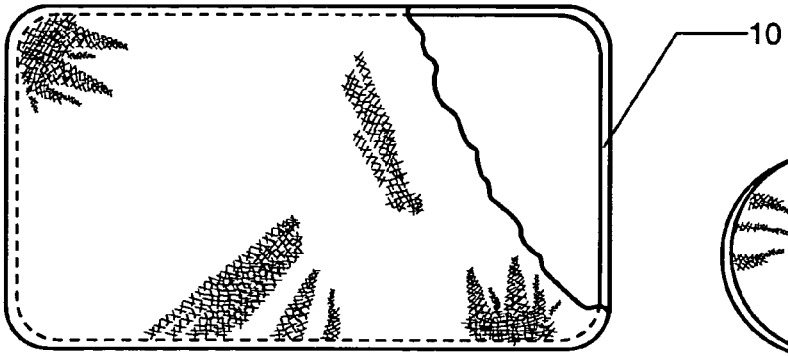
FIG. 8 (PRIOR ART)
FIG. 8. illustrates a top view of an elongated structure of a generally rectilinear shape and at least one layer of flexible material.
Figure 9:
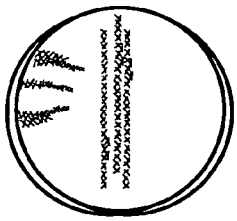
FIG. 9 (PRIOR ART)
FIG. 9. illustrates a top view of a folded configuration for an elongated structure of a generally rectilinear shape and at least one layer of flexible material.

Referring now to FIG. 8 and FIG. 9, there is shown a second embodiment for collapsing a structure into a reduced volume. Specifically, a collapsible structure of a generally rectilinear shape and at least one layer of flexible material, as is known in the art, is illustrated. In this embodiment, the at least one layer of flexible material is secured to a ring support 10 of a spring-like material, which serves as the perimeter of the collapsible structure. In one embodiment the spring-like material used may be deformable and nonconductive. In a second embodiment, the spring-like material used may be deformable and conductive. The elongated structure can easily and conveniently collapse into a compact configuration for storage when not in use as is illustrated in FIG. 9. The preferred method of collapsing the elongated structure comprises grasping the ring support 10 at its extreme ends, twisting the ends in opposite screw senses while simultaneously bringing them toward each other, and forming a predetermined number of interleaved sections consisting of generally circular loops. In one embodiment, the flexible material may be formed of a deformable, nonconductive material or fabric. In a second embodiment, the flexible material may be formed of a deformable, conductive material or fabric. In a third embodiment, a flexible material may be formed from multiple layers of deformable, conductive material; multiple layers of deformable, nonconductive material; or both. The general structure and method of collapsing as illustrated in FIG. 8 and FIG. 9 may be utilized for a deployable antenna.

Figure 10:
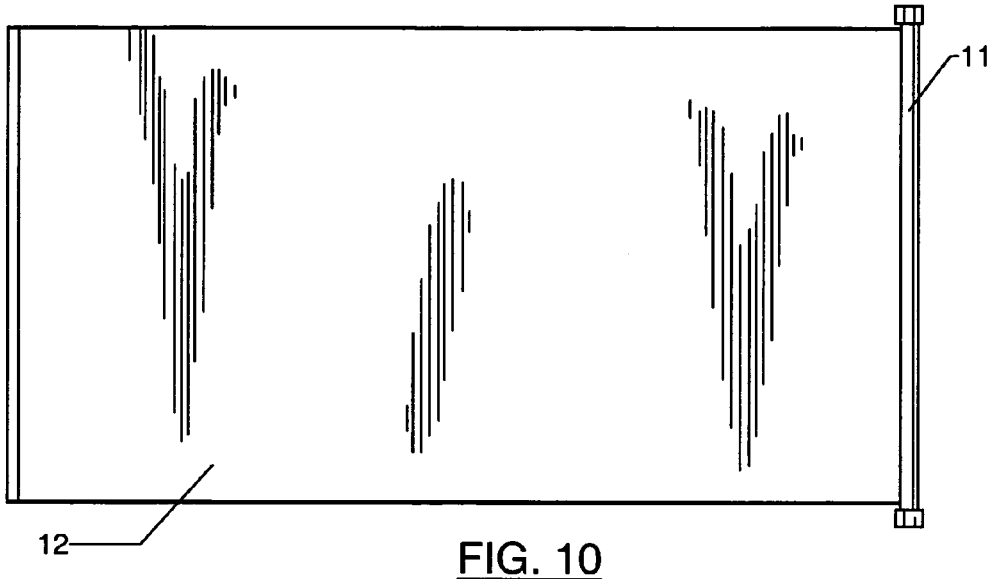
FIG. 10 (PRIOR ART)
FIG. 10. illustrates a top view of a tubular structure that houses a revolving sleeve (not shown) concentrically attached to the tubular structure and sheet of predetermined material that engages and is wound around the revolving sleeve.
Figure 11:
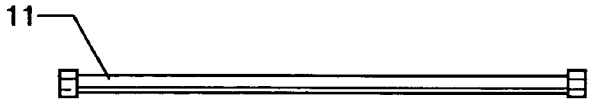
FIG. 11 (PRIOR ART)
FIG. 11. illustrates a side view the collapsed configuration of a tubular structure wherein a sheet is wound into the structure by a revolving sleeve (not shown).

Referring now to FIG. 10 and FIG. 11, there is shown a third embodiment for collapsing a structure into a reduced volume. Specifically, a tubular central axle 11 houses a revolving sleeve (not shown) concentrically attached to the tubular central axis 11. A sheet 12 of predetermined material engages and is wound around the revolving sleeve. The device may include an auto-rewinding system (not shown), which may be installed between the central axle and the revolving sleeve for driving the sleeve to rotate so as to automatically rewind the sheet around the revolving sleeve. FIG. 11 illustrates the device in its collapsed configuration. In one embodiment, a collapsible membrane formed of a deformable, nonconductive material or fabric may be used as the predetermined material. In a second embodiment, a collapsible membrane formed of a deformable, conductive material or fabric may be used as the predetermined material. In a third embodiment, a collapsible membrane may be formed from multiple layers of deformable, conductive material; multiple layers of deformable, nonconductive material; or both as the predetermined material. The general structure and method of collapsing as illustrated in FIG. 10 and FIG. 11 may be utilized for a deployable antenna.

As an example, an umbrella, as is commonly known in the art, is a fourth embodiment for collapsing a structure into a reduced volume (not shown). In an embodiment, a collapsible membrane formed of at least one layer of deformable, nonconductive material; at least one layer of deformable, conductive material; or both, wherein the collapsible membrane may be used as the umbrella's canopy material. The general structure and method of collapsing an umbrella may be used for a deployable antenna.

The various examples for multiple embodiments of collapsing a structure into a reduced volume and for collapsible membranes, are provided to illustrate a wide range of embodiments. A deployable antenna as defined herein has broad applications and is not limited to generally planar shapes. A wide range of three-dimensional shapes may be used, such as an umbrella shape. In addition, for example, the collapsible membrane may be in the shape of a deployable tent; a shirt that is unfolded and worn; a baseball cap that is unfolded and worn; a deployable pet water bowl; a deployable trash receptacle; a foldable bag such as a locker bag; or any arbitrary shape.

In one embodiment, a deployable antenna is comprised of a collapsible membrane and at least one boundary component, radiating element, or subarray attached to the collapsible membrane. In a second embodiment, each radiating element or subarray may be a cavity antenna element, or, more specifically, a microstrip or patch antenna. In a third embodiment, each radiating element or subarray may be a current antenna element. In a third embodiment, the deployable antenna may further comprise at least one transmission line electrically connected on one end to at least one boundary component, radiating element, or subarray. In a fourth embodiment, the deployable antenna may further comprise an antenna interface adapter electrically connected to one transmission line on the one transmission line's second end. The antenna interface adapter can be either a wire-based antenna interface adapter or wireless antenna interface adapter. In a fifth embodiment, the deployable antenna may further comprise a support means for supporting the membrane and overall antenna structure at a predetermined angle relative to a surface. A stand is one support means for supporting the membrane and overall structure at a predetermined angle relative to the surface. A platform is a second support means for supporting the membrane and overall structure at a predetermined angle relative to the surface. A rack is a third support means for supporting the membrane and overall structure at a predetermined angle relative to the surface. A mount is a fourth support means for supporting the membrane and overall structure at a predetermined angle relative to the surface. Examples of a mount include, but are not limited to, a clamp, suction, semi-permanent mount such as a base plate and screws, or a permanent mount such as a mount welded to a surface. In a sixth embodiment, the deployable antenna may further comprise at least one passive distribution network, active distribution network or both electrically connected to at least one transmission line on the at least one transmission line's second end. A distribution network may be at least one power divider, filter, amplifier, phase shifter, or any combination, where the term "power divider" is meant to describe a device that is used for either the splitting, combining, or splitting and combining of signals. In a seventh embodiment, the deployable antenna may further comprise a plurality of fasteners, or standoffs, of nonconductive material and of predetermined length wherein one end of each fastener is attached to the collapsible membrane and wherein the second end of each fastener is attached to a reflector. In an eighth embodiment, the deployable antenna may further comprise an independent power source and associated power distribution subsystem. In a ninth embodiment, the deployable antenna may further comprise a container for stowage purposes, carrying purposes, or both. In a tenth embodiment, the deployable antenna may comprise any combination of the embodiments described above.

As indicated by the multiple embodiments for a collapsible membrane describe above, multiple embodiments for a collapsible membrane relative to shapes, structures, and configurations may be used. The examples shown in FIGS. 5 through 11 serve to illustrate various embodiments. In addition to shapes, structures, and configurations, multiple embodiments for the membrane's material exist. In one embodiment, the membrane may be formed of a flexible, nonconductive material. In a second embodiment, the flexible, nonconductive material may be selected from a group consisting of fabric, plastic, and paper. In a third embodiment, the membrane may be formed of a flexible, conductive material. Multiple embodiments for collapsing the membrane may be used. In one embodiment, the membrane may collapse through sectional folding similar to general structure and method of collapsing as shown in FIG. 5, FIG. 6, and FIG. 7. In a second embodiment, the membrane may collapse into a plurality of concentric sections by twisting ends in opposite screw senses as shown in FIG. 8 and FIG. 9. In a third embodiment, the membrane may collapse by a re-winding mechanism as shown in FIG. 10 and FIG. 11. In a fourth embodiment, the membrane may collapse in a manner similar to an umbrella (not shown). Various shapes for the membrane may be used. For example, in one embodiment the membrane may be generally rectilinear in shape. In a second embodiment, the membrane may be generally ellipsoidal in shape. In a third embodiment, the membrane may be arbitrary and asymmetrical in shape whether in two dimensions or three dimensions. In a fourth embodiment, the membrane may have a thin, planar profile. In sum, any shape can be used. The membrane may collapse into a various number of sections. In a one embodiment, the membrane may collapse into a plurality of sections. In a second embodiment, the membrane may collapse into one section, such as the membrane retracting into the tubular sleeve.

Multiple radiating means exist for transmitting electromagnetic waves, receiving electromagnetic waves, or both. For example, a radiating element is a first radiating means for transmitting electromagnetic waves, receiving electromagnetic waves, or both. A subarray is a second radiating means for transmitting electromagnetic waves, receiving electromagnetic waves, or both, where the subarray comprises at least one radiating element and may further comprise at least one parasitic element. An array antenna is a third radiating means for transmitting electromagnetic waves, receiving electromagnetic waves, or both. As described above, a radiating element may comprise at least one parasitic element in addition to at least one driven element.

Multiple embodiments of the radiating element, subarray, or array exist such that each radiating element, subarray, or array provides the bandwidth required for a given application. For example, in one embodiment, the radiating element is designed for a 100 MHz bandwidth centered at 850 MHz for application in a cellular telephone band. Such a radiating element may be a dual-side, printed dipole in a bow-tie configuration (not shown). In a second embodiment, the radiating element may be in a loop or spiral configuration (not shown) with at least one arm. In a third embodiment, the radiating element may comprise a bottom boundary component (e.g., a ground plane), a substrate, a feed network, and a top boundary component (e.g., a patch) (see FIG. 1 or FIG. 19 as examples). Also, multiple embodiments exist in which parasitic elements are used to enhance the bandwidth of at least one radiating element, subarray, or array. Multiple embodiments for materials exist as well. For example, in one embodiment, the boundary component and feed network may be formed of a conductive material such as a metal, alloy, or superconductive material. In a second embodiment, the boundary component and feed network may be formed of a conductive fabric. In a third embodiment, the metal may be selected from a group consisting of aluminum, copper, brass, gold, tin, nickel, and silver. In a fourth embodiment, the boundary components and feed network may be formed from metallic mesh. In a fifth embodiment, the substrate or any nonconductive material used to separate or space boundary components may be any material with a dielectric constant greater or equal to 1. In a sixth embodiment, the substrate or any nonconductive material used to separate or space boundary components is a nonconductive fabric.

Multiple embodiments for attaching the radiating means to the collapsible membrane exist. For example, in one embodiment, stitching is a first attachment means for attaching the radiating means to the collapsible membrane. In a second embodiment, embroidering with conductive or nonconductive thread is a second attachment means for attaching the radiating means to the collapsible membrane. In a third embodiment, weaving is a third attachment means for attaching the radiating means to the collapsible membrane. In a fourth embodiment, placing the radiating means in a sleeve integrated into the collapsible membrane is a fourth attachment means. In a fifth embodiment, knitting is a fifth attachment means for attaching the radiating means to the collapsible membrane.

Multiple embodiments for a transmission line exist. For the purposes herein, the transmission line is defined as anything that provides transfer of electrical energy from one component to another component. A transmission network is defined as comprising at least one transmission line and at least one distribution network. A distribution network is defined as being a set of at least one component, which include filters, amplifiers, phase shifters, and power dividers, that multiplexes at least one input transmission line into at least one output transmission line, wherein the number of output transmission lines is not necessarily equal to the number of input transmission lines, and the relative amplitude and phase of each output transmission line with respect to the at least one input transmission line is predetermined. A power splitter/combiner is an example of a distribution network. Multiple embodiments for transmission line materials exist. For example, in one embodiment, the transmission line is comprised of a conductive, flexible material. In a second embodiment, the transmission line may comprise flexible printed circuit material. In a third embodiment, the transmission line may comprise conductive and insulative fabrics. Multiple embodiments for the transmission line (itself) exist. For example, in one embodiment, the transmission line is a coaxial line, either flexible or semi-rigid. In a second embodiment, the transmission line may be a stripline comprising two ground covers and a center conductor all formed of conductive fabric and two nonconductive fabrics to isolate the center conductor and ground covers. In a third embodiment, the transmission line may be a microstrip line which comprises a top conductor formed of conductive fabric, a substrate of nonconductive fabric, and a ground plane of conductive fabric. In a fourth embodiment, the transmission line may be a plurality of twin coupled coplanar strips. In a fifth embodiment, the transmission line may be formed of stacked and aligned strips of conductive fabric separated by a nonconductive fabric. In a sixth embodiment, the transmission line may be a coplanar waveguide. In a seventh embodiment, the transmission line is selected from a group consisting of a coaxial line, a slotline, a stripline, a microstrip, and a twin coupled line. Multiple embodiments for attaching the transmission line or transmission network to the collapsible membrane exist. For example, in one embodiment, stitching is a first transmission line and network attachment means for attaching the transmission line and transmission network to the collapsible membrane. In a second embodiment, embroidering is a second transmission line and network attachment means for attaching the transmission line and transmission network to the collapsible membrane. In a third embodiment, weaving is a third transmission line and network attachment means for attaching the transmission line and transmission network to the collapsible membrane. In a fourth embodiment, placing the transmission line and transmission network in a sleeve integrated into the collapsible membrane is a fourth transmission line and network attachment means for attaching the transmission line and transmission network to the collapsible membrane. In a fifth embodiment, knitting is a fifth transmission line and network attachment means for attaching the transmission line and transmission network to the collapsible membrane.

Multiple embodiments for the distribution network exist. In one embodiment, the distribution network is created using microstrip technology with conductive fabrics. In a second embodiment, the distribution network is created using stripline technology with conductive fabrics. In a third embodiment, the distribution network is created using conventional technologies for RF power distribution.

The antenna interface adapter generally provides an interface between the transmission network or transmission line and a mobile communication unit's transmission line. The antenna interface adapter may also provide an interface to a boundary component, a ground plane boundary component, or a radiating element. The antenna interface adapter functions to transform the transmission line technology from that used by the mobile communication unit to that used by the transmission network. In addition, the antenna interface adapter may provide at least one impedance transformation to avoid reflections at this interface. For example, in one embodiment, the transmission network for the deployable antenna is comprised of microstrip lines, and the mobile communication unit's transmission line is a coaxial cable. In this embodiment, the adapter will provide a transition from microstrip to coaxial cable. Multiple embodiments for an adapter exist. For example, in one embodiment, the adapter may comprise a thin laminate with a printed circuit. In a second embodiment, the adapter may comprise a balun. In a third embodiment, the adapter provides a transition from a coaxial transmission line to a fabric based transmission line. In a fourth embodiment, the adapter provides a transition from a coaxial transmission line to twin coupled strip, either horizontal or vertical, transmission line. In a fifth embodiment, the adapter is a wireless adapter that interfaces with a mobile communication unit's wireless system. In this embodiment, the adapter provides a region in which the signal is coupled electromagnetically between the mobile communication unit and the deployable array antenna.

In another embodiment, a deployable antenna is comprised of a collapsible membrane and at least one array antenna attached to the membrane (not shown). As described previously, an array antenna may comprise a plurality of at least one radiating element, at least one parasitic element, at least one subarray, or any combination. In a second embodiment, the deployable antenna may further comprise at least one transmission line electrically connected to at least one array antenna. In a third embodiment, the deployable antenna may further comprise at least one distribution network electrically connected to at least one transmission line. In a fourth embodiment, the deployable antenna may further comprise an antenna interface adapter electrically connected to one of the at least one transmission line. In a fifth embodiment, the deployable antenna may further comprise a support means for supporting the membrane and overall antenna structure at a predetermined angle relative to a surface. In a sixth embodiment, the deployable antenna may further comprise a plurality of fasteners of nonconductive material and of predetermined length and a reflector wherein one end of each fastener is attached to the membrane, and the second end of each fastener is attached to the reflector.

In another embodiment, a deployable antenna is comprised of a collapsible back layer, a collapsible front layer, and at least one radiating means attached to either the back layer or the front layer. Further, in this embodiment, the back and front layers may serve to provide weather-proof protection for the radiating means.

As stated earlier, multiple embodiments for a collapsible membrane relative to shapes, structures, and configurations may be used. For example, in one embodiment, the collapsible membrane may have at least one slot. In a second embodiment, each slot may be designed to reduce wind loads (not shown). Further, in a third embodiment, if the collapsible membrane is formed of conductive material, each slot may represent at least one radiating element (i.e., a radiating slot) in a sense described by Babinet's Principle. In a fourth embodiment, at least one non-perimeter structural support may be attached to the collapsible membrane (not shown). Also discussed earlier, several configurations may consist of a plurality of collapsible sections. In one embodiment, the number of radiating elements, parasitic elements, subarrays, or array antennas is equivalent with the number of sections (not shown). Multiple embodiments exist for arranging each radiating element, parasitic element, subarray, or array antenna on the membrane. For example, in one embodiment, one radiating element, parasitic element, subarray or array antenna is attached to one section. In a second embodiment, there may be a plurality of radiating elements, parasitic elements, subarrays, or array antennas attached to a section (not shown). In a third embodiment, the radiating element, parasitic element, subarray, or array antenna may cross over into a plurality of sections. In a fourth embodiment, the number of radiating elements, parasitic elements, subarrays, or array antennas is not equivalent with the number of sections. Further, in a fifth embodiment, at least one group of three radiating elements, parasitic elements, subarrays, or array antennas may be configured in a triangular pattern relative to each other, such as the triangular pattern illustrated in FIG. 12. In a sixth embodiment, at least one group of four radiating elements, parasitic elements, subarrays, or array antennas are configured in a rectilinear pattern whereby a radiating element, parasitic element, subarray, or array antenna is positioned at or near each of the four corners of the rectilinear pattern (not shown). In a seventh embodiment, a plurality of radiating elements arranged in a hex lattice configuration comprising an array antenna (not shown). In an eighth embodiment, a plurality of radiating elements arranged in a ring comprising an array antenna, wherein at least one radiating element may be included in the center of the ring (not shown).

Multiple embodiments for the number of collapsible membranes also exist. For example, in one embodiment, a deployable antenna is comprised of at least one collapsible membrane and at least one radiating element attached to the at least one collapsible membrane (not shown). In a second embodiment, an antenna may be comprised of a plurality of collapsible membranes; at least one radiating element attached to the plurality of collapsible membranes; and an antenna interface adapter electrically connected to the at least one radiating element (not shown). In a third embodiment, an antenna may comprise a plurality of collapsible membranes; a plurality of radiating elements attached to the plurality of collapsible membranes; at least one transmission line electrically connected to the plurality of radiating elements; and at least one distribution network electrically connected to the at least one transmission line (not shown).

Figure 12:
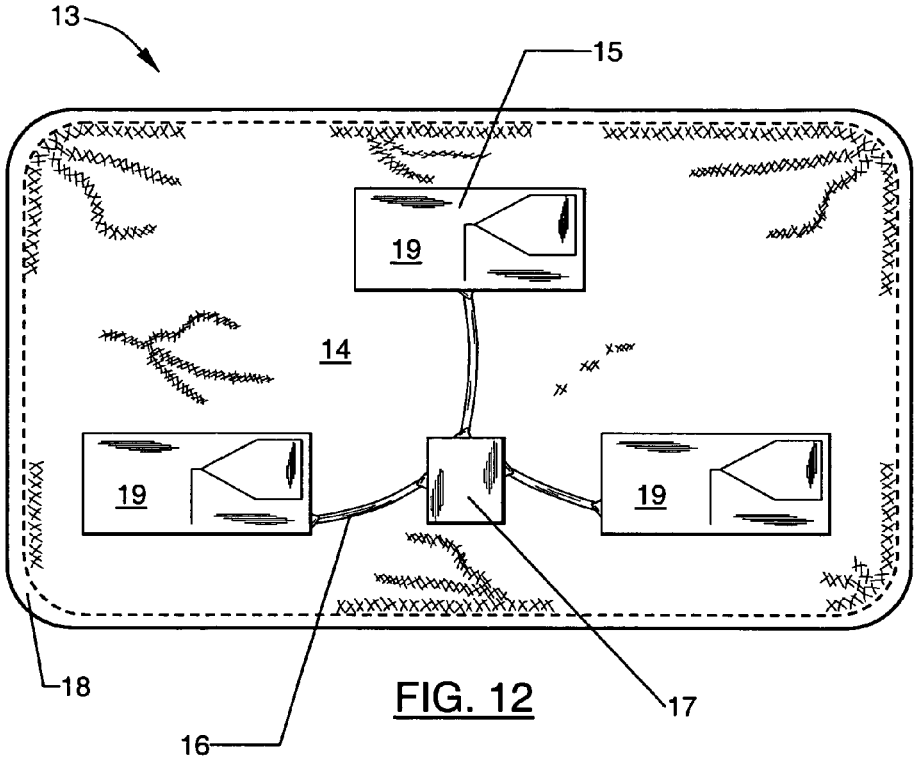
FIG. 12. illustrates, as an example, a top view of an embodiment of a deployable antenna.
Figure 13:
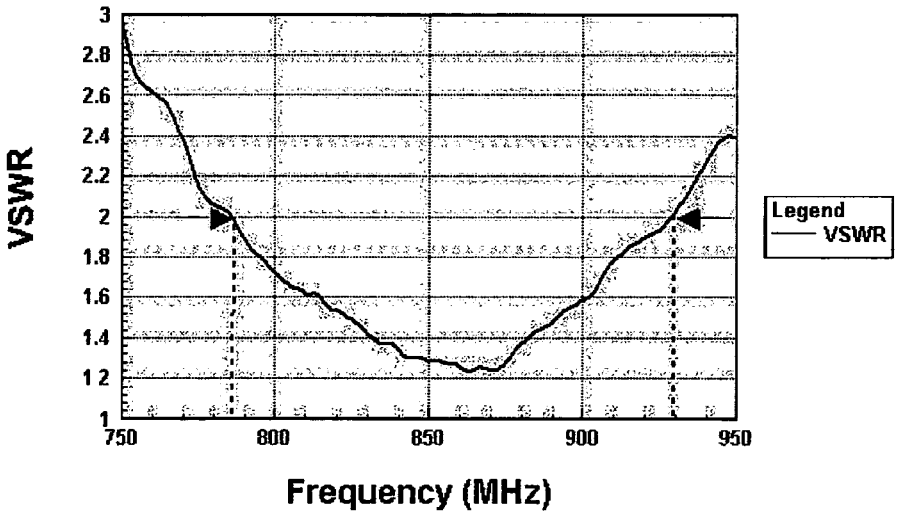
FIG. 13. illustrates the impedance bandwidth for the deployable antenna illustrated in FIG. 12.
Figure 14:
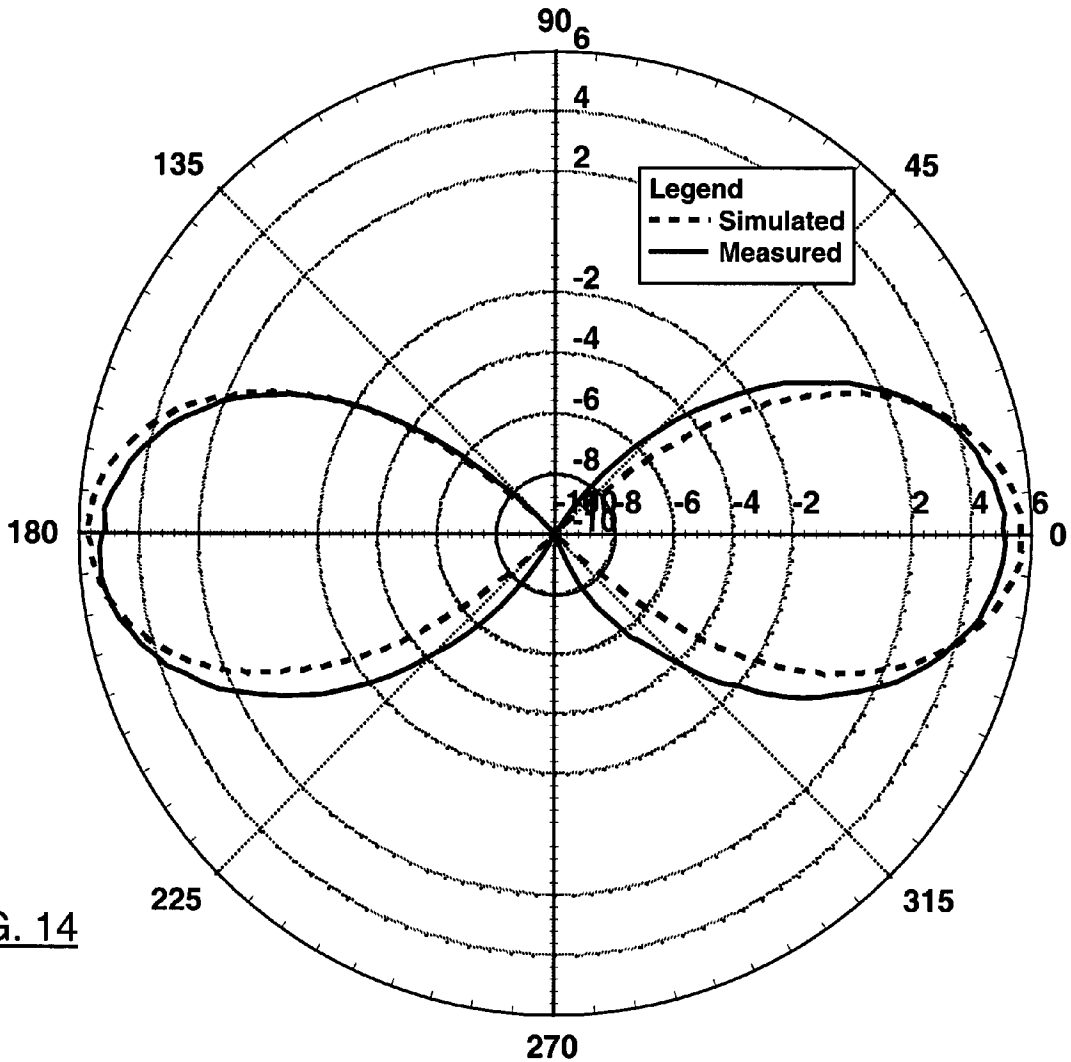
FIG. 14. illustrates the E-plane radiation pattern (dBi) for the deployable antenna illustrated in FIG. 12.
Figure 15:
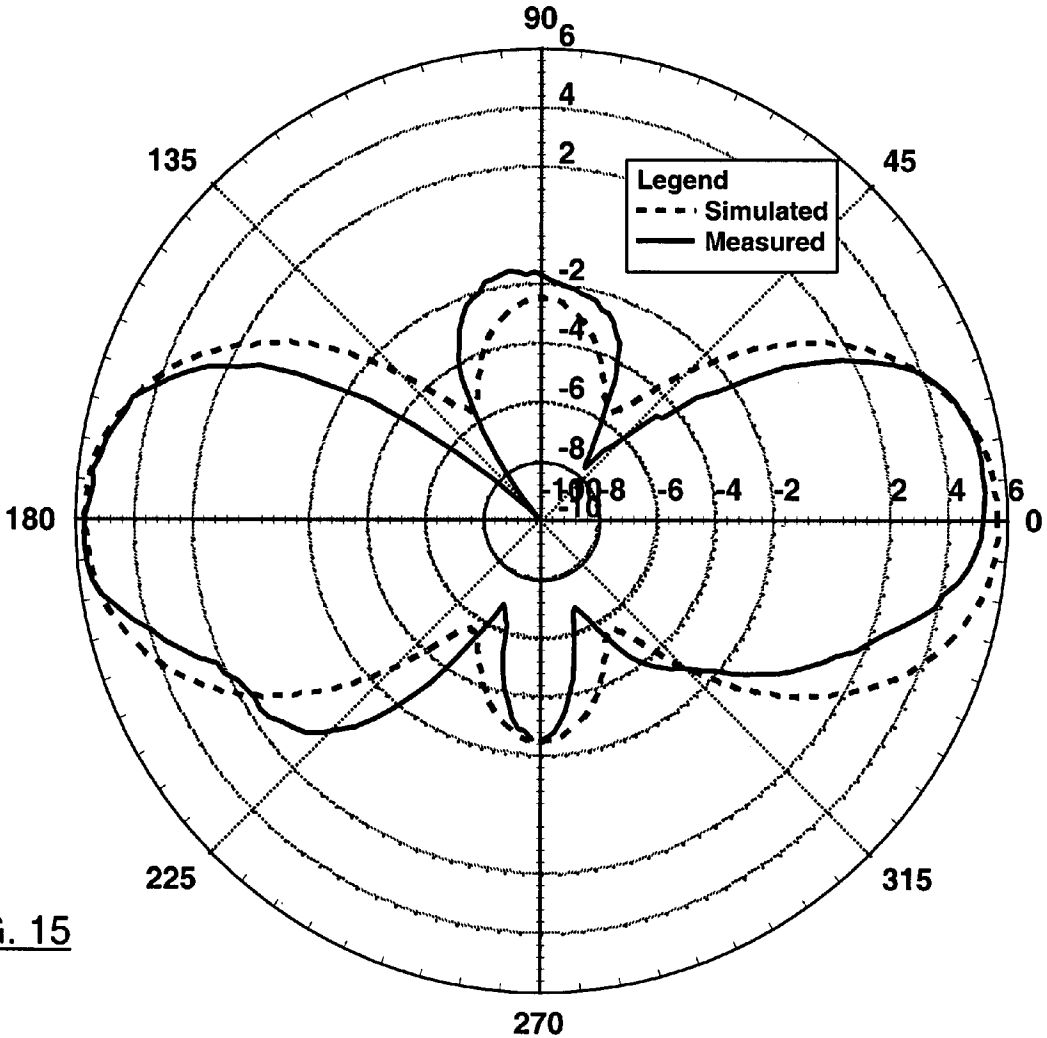
FIG. 15. illustrates the H-plane radiation pattern (dBi) for the deployable antenna illustrated in FIG. 12.

Referring now to FIG. 12, there is shown an embodiment of a deployable antenna, as an example. The antenna 13 is comprised of a collapsible membrane 14, at least three radiating elements 15 attached to the membrane in a triangular pattern, a plurality of transmission lines 16 attached to the radiating elements 15 on one end of each transmission line 16, and a distribution network 17 comprised of a power divider attached to the plurality of transmission lines 16 on the second end of each transmission line 16. The antenna 13 further comprises a sewn-in ring support 18 of spring-like material that supports the membrane around its perimeter and also serves in the method for collapsing a membrane as illustrated in FIG. 9. In addition, the ring support may be formed of conductive or non-conductive, deformable, spring-like material. The nonconductive, deformable, spring-like material may be selected from a group consisting of fiberglass, carbon, and carbon-glass composites. The conductive, deformable, spring-like material may serve as a radiating element. The membrane 14 is formed of a flexible, nonconductive material and collapses in a like method as illustrated in FIG. 9. The radiating elements 15 are dual-sided printed dipoles in a bow-tie configuration with printed twin line feeds. The transmission lines 16 are formed of 50-Ohm coaxial cable that electrically connect to a microstrip-to-twin line impedance matching circuit. The twin line intersects the dipole arms at the center. Both the radiating elements 15 and matching feed network (not shown) are printed on a single 0.020-inch thick FR-4 dielectric substrate 19. The resonant length of the dipole is about 4.7 inches, which corresponds to 0.34 wavelengths at the 850 MHz cellular telephone band center. The measured 2:1 voltage standing wave ratio (SWR) bandwidth of the dipole element is 140 MHz (790 MHz to 930 MHz) as shown in FIG. 13. The measured and simulated gain patterns (dBi) for this particular embodiment are illustrated in FIG. 14 and FIG. 15.

Other embodiments, discussed previously, may be utilized to increase the antenna gain. In one embodiment, subarrays may be utilized in place of single radiating elements to populate a larger membrane (not shown). In a second embodiment, alternative spacing and pattern designs may improve antenna gain and minimize grating lobes (not shown). In a third embodiment, any combination of radiating elements, parasitic elements, subarrays, or array antennas, transmission lines, distribution networks, and antenna interface adapter are used. In a fourth embodiment, the radiating elements, subarrays, or arrays comprise current elements; and a reflector may be placed behind the radiating elements, parasitic elements, subarrays, or array antennas. In a fifth embodiment, the reflector is spaced at one-quarter wavelength from the radiating elements, parasitic elements, subarrays, or arrays, all of which are of the current element type. Multiple embodiments for the reflector exist. For example, in one embodiment, the reflector may comprise a flexible metallic mesh or screen. In a second embodiment, the reflector may be of a similar shape and design as the collapsible membrane. In a third embodiment, the reflector may comprise at least one printed or etched conductive sheet on deformable material. Spacers or fasteners may be placed in between the reflector and membrane to adequately separate these two components. In one embodiment, the fasteners or spacers may comprise nonconductive material.

Figure 16:
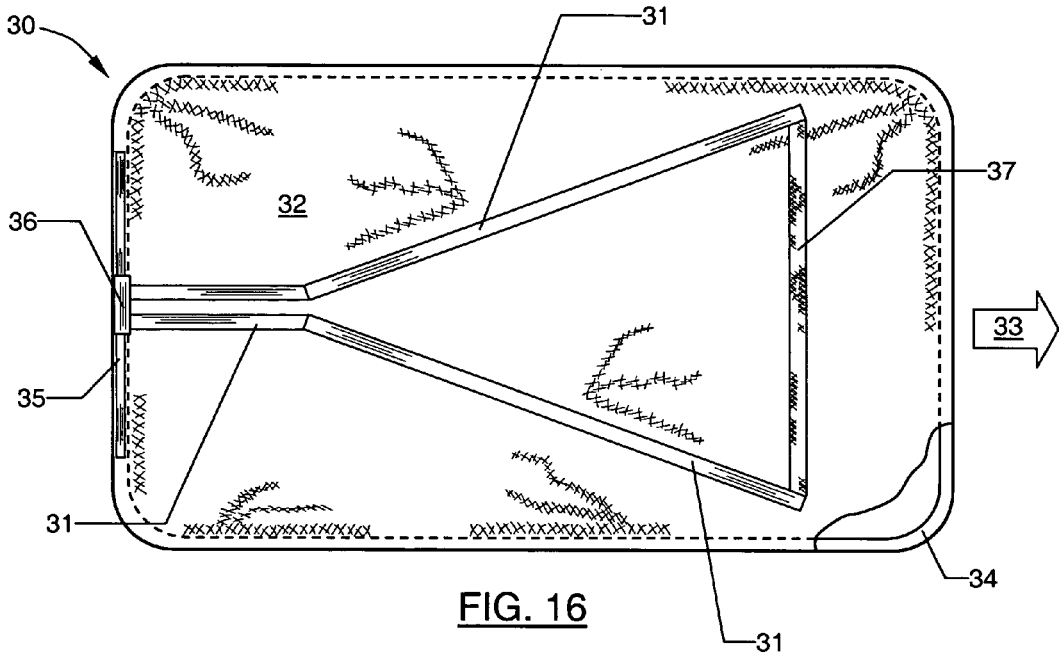
FIG. 16. illustrates, as an example, a top view of an embodiment of a deployable "V" antenna comprised of two elongated boundary components attached to a collapsible membrane in a generally parallel and longitudinal manner relative to the principal direction of radiation.
Figure 17:
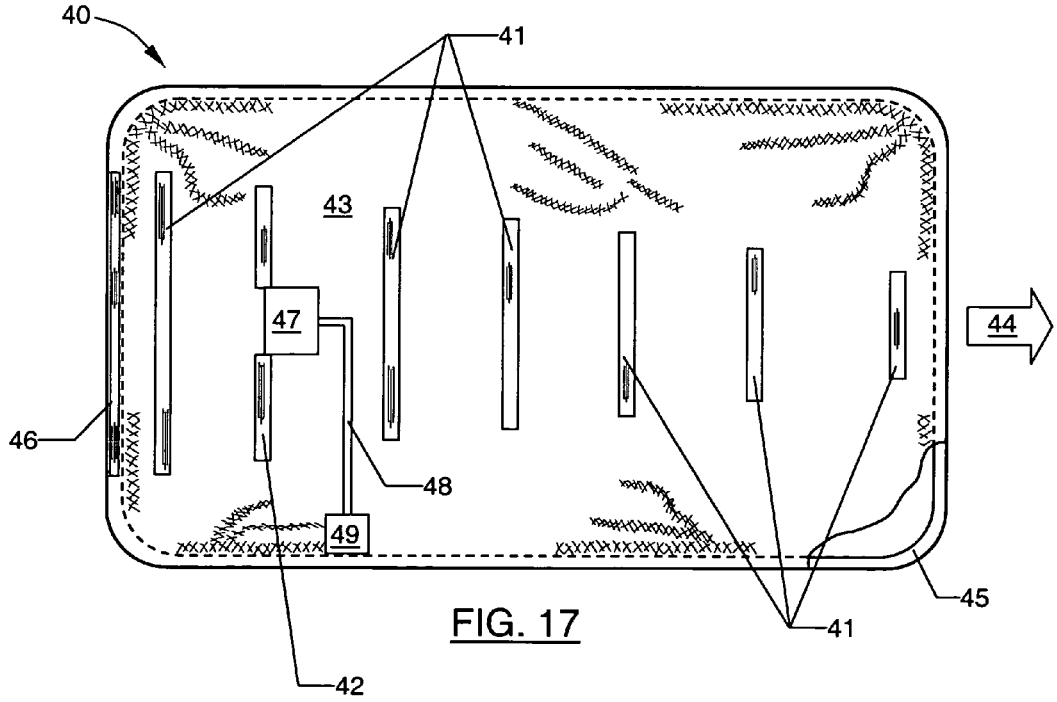
FIG. 17. illustrates, as an example, a top view of an embodiment of a deployable antenna comprised of plurality of elongated radiating elements attached to a collapsible membrane in a generally perpendicular manner relative to the principal direction of radiation.

In a traveling wave antenna, at least one radiating element, parasitic element, or boundary component function to guide a traveling wave that radiates while propagating along the guiding structure. Multiple embodiments exist for radiating means that are designed to guide a traveling wave. In one embodiment, the vector describing the principal direction of radiation lies in the plane of a collapsible membrane. One example of this embodiment is shown in FIG. 16, which is a deployable version of what is often referred to as a 'V' antenna. Here, a deployable antenna 30 is comprised of an array antenna, which is comprised of a plurality of elongated boundary components 31 attached to a collapsible membrane 32 in a generally parallel and longitudinal manner in the principal direction of radiation 33. The angle between and the lengths of the two boundary components 31 may be altered to affect the radiation pattern as is known in the art for conventional "V" antennas. In this embodiment, a ring support 34 is incorporated wherein the ring support may be formed of a nonconductive, deformable, spring-like material. The nonconductive, deformable, spring-like material may be selected from a group consisting of fiberglass, carbon, and carbon-glass composites. Further, in this embodiment, a backedge 35 formed of a conductive material is attached to the collapsible membrane 32 to help suppress backside radiation. An antenna interface adapter 36 electrically connects the radiating elements 31 to the backedge 35. In this embodiment, a resistive load in the form of an elongated resistance 37 is added between the ends of the "V" to eliminate reflections. The nominal resistance of this load is equal to the characteristic impedance of the waveguide established by the two radiating elements 31 when the spacing is given by the separation at the end. This resistance 37 may be formed of at least one weakly conductive fabric to provide the optimal resistance for impedance matching. Referring to FIG. 17, in a second embodiment, a deployable traveling wave antenna 40 is comprised of at least one elongated parasitic element 41 and at least one driven element 42, attached to a collapsible membrane 43 in a design typical of a Yagi-Uda antenna. In this embodiment, the driven and parasitic elements are substantially orthogonal to the principal direction of radiation 44, as is the primary polarization. Other radiating elements, parasitic elements, subarrays, or any combination of radiating elements, parasitic elements, and subarrays may also be used in place of the driven elements 41 or each parasitic element 42. In addition, in this embodiment, a ring support 45 is incorporated wherein the ring support may be formed of a non-conductive, deformable, spring-like material. Further, in this embodiment, a backedge 46 formed of a conductive material is attached to the collapsible membrane 43 to help suppress backside radiation. Still further, in this embodiment, a balun 47 is electrically connected to a transmission line 48 and driven element 42 wherein the balun 47 serves as a transition between the transmission line 48 and driven element 42. Still further, an antenna interface adapter 49 is electrically connected to the transmission line 48. The balun 47, transmission line 48, and antenna interface adapter 49 are illustrated in FIG. 17 as separate elements, however, all three elements may be referred as simply an antenna interface adapter. In another embodiment, the driven element 42 and parasitic elements 41 are slots in a conductive membrane 43. In this embodiment, the perimeter may be a conductive material without interfering with radiation in the primary direction 44.

In another embodiment, a deployable antenna is a deployable wedge antenna that comprises the basic embodiments illustrated in FIG. 16 or FIG. 17, referred to as a center antenna, which is used in combination with a second and third collapsible membrane secured to the center antenna and wherein the second and third collapsible membranes are formed of a flexible, conductive material (not shown). If the radiating elements or radiating means attached to the center antenna are cavity antenna elements, then a third collapsible membrane is not required, and the combination of the ground plane component of the cavity antenna elements and the second collapsible membrane forms a wedge when fully deployed. Otherwise, the combination of the second and third collapsible membranes forms a wedge when fully deployed (not shown). In either of these embodiments, the wedge, which is conductive, forms a larger antenna aperture than the center antenna by itself; thereby creating increased directivity in the antenna pattern. In another embodiment, a separate ring support is attached to the perimeter of each of the second and third collapsible membranes (not shown). In this embodiment, each combination of a ring support and collapsible membrane is deployable as illustrated in FIG. 8 and FIG. 9. In still a further embodiment, the deployable wedge antenna may further comprise a perimeter ring formed of nonconductive material and wherein the perimeter ring surrounds the center antenna and second collapsible membrane or the center antenna, second collapsible membrane, and third collapsible membrane.

In another embodiment (not shown), a deployable antenna is a second deployable wedge antenna comprised of a first and second boundary component comprised of a first and second collapsible membrane, respectively, both formed of a flexible, conductive material; a first ring support attached to the first collapsible membrane at its perimeter; a second ring support attached to the second collapsible membrane at its perimeter; a feed probe electrically connected to the first collapsible membrane wherein the feed probe's first end is electrically connected to the first boundary component inside the perimeter of the first ring support, wherein the feed probe is not electrically connected to the second boundary component, wherein the feed probe passes through the second boundary component; and an antenna interface adapter electrically connected to the feed probe's second end. Further, in this embodiment, the first and second ring supports are coupled to each other in such a way as to allow folding the first and second rings with respect to each other, thus, capable of forming a wedge. The second deployable wedge antenna may further comprise a prop formed of a semi-rigid or rigid, nonconductive material and attached to the second wedge antenna in the second wedge antenna's deployed state to aid in sustaining the wedge. In still another embodiment, the elements described above remain the same with the exception that the feed probe is a loop-type feed (not shown). Specifically, the feed probe passes through the second boundary component, loops back and is electrically connected to the second boundary component on the feed probe's first end. In yet another embodiment, the elements and alternative embodiments as described above remain the same with the exception that there is one boundary component comprised of one collapsible membrane formed of a flexible, conductive material (not shown). In this embodiment the first and second ring supports are both attached to the single boundary component and do not come in physical contact with each other. Further, the first and second ring supports are both attached in such a way as to allow folding the first and second ring supports with respect to each other, thus capable of forming a wedge. The feed probe is electrically connected to the boundary component inside the perimeter of the first ring support on the feed probe's first end, wherein the feed probe passes through the perimeter of the second ring support and is attached to an antenna interface adapter on the feed probe's second end. Alternatively, the feed probe may be a loop-type feed wherein the feed probe passes through the boundary component inside the perimeter of the second ring support, loops back and is electrically connected to the boundary component inside the perimeter of the second ring support. In all the embodiments described above, two side boundary components, formed of a flexible, conductive material, may be electrically connected to the wedge antenna in such a manner as to further increase the directivity of the antenna or to alter the input impedance characteristics of the antenna in its deployed state. For example, if first and second boundary components are used, the side boundary components may be electrically connected to the first and second boundary components. In this manner, the deployable antenna may resemble, in its fully deployed state, a conventional horn antenna in appearance and function.

Figure 21:
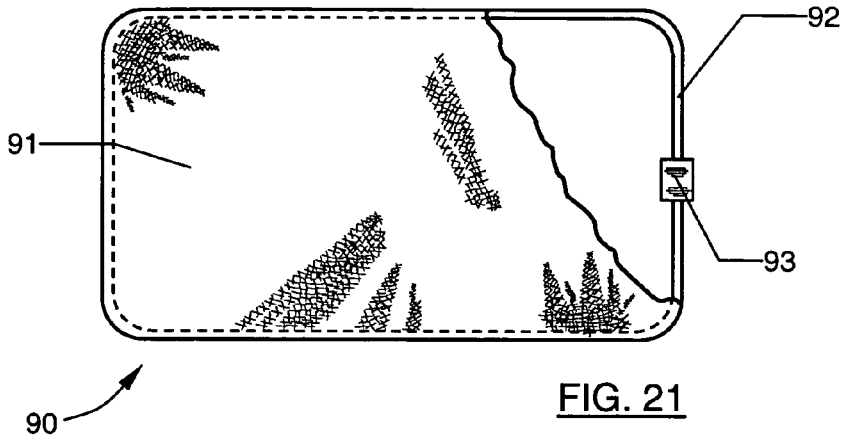
FIG. 21 illustrates, as an example, a deployable antenna comprised of a collapsible membrane formed of a nonconductive material; a ring support attached to the perimeter of the collapsible membrane wherein the ring support is formed of a conductive, deformable, spring-like material; and an antenna interface adapter electrically connected to the ring support.
Figure 22:
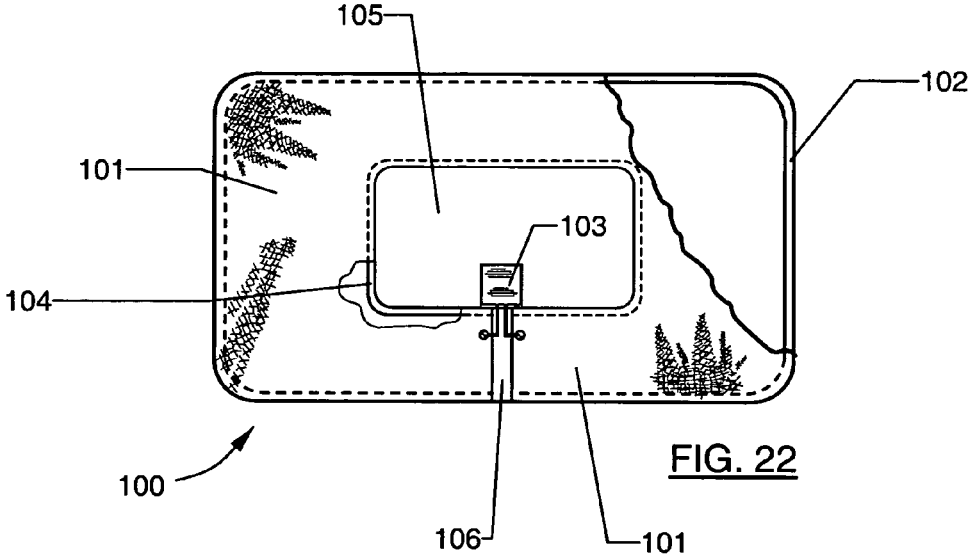
FIG. 22 illustrates, as an example, a deployable antenna comprised of a radiating element ring secured to a first and second ring support formed of a deformable, spring-like material; and an antenna interface adapter comprising a balun electrically connected to the radiating element ring.
Figure 23:
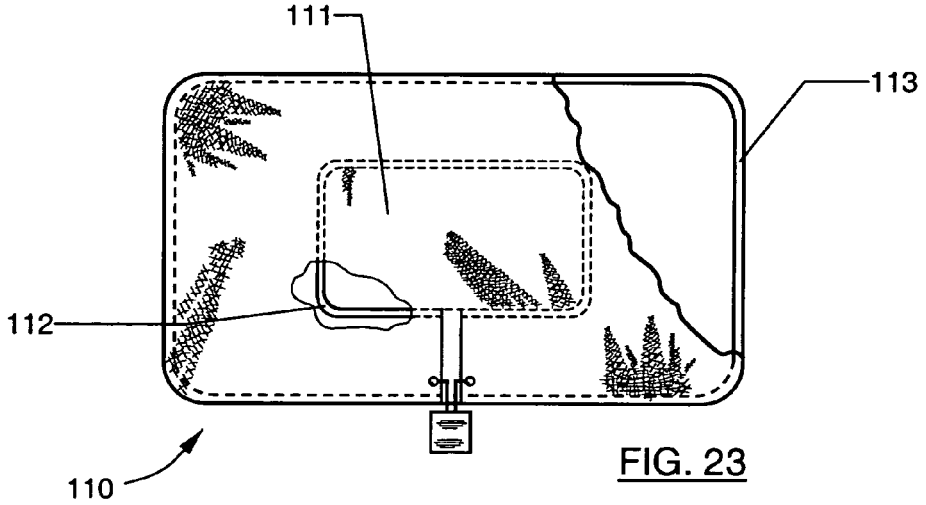
FIG. 23 illustrates, as an example, a deployable antenna comprised of a radiating element ring secured to a first and second ring support formed of a deformable, spring-like material; an antenna interface adapter comprising a balun electrically connected to the radiating element ring; and a collapsible membrane formed of a nonconductive material wherein the perimeter of the collapsible membrane is secured to the second ring support.

In another embodiment illustrated in FIG. 21 a deployable antenna 90 is comprised of a collapsible membrane 91 formed of a nonconductive material; a ring support 92 attached to the perimeter of the collapsible membrane wherein the ring support 92 is formed of a conductive, deformable, spring-like material; and an antenna interface adapter 93 electrically connected to the ring support 92. The ring support 92 is used to deploy the collapsible membrane and is also a resonant loop antenna. In another embodiment illustrated in FIG. 22, a deployable antenna 100 is comprised of a radiating element ring 101 secured to a first ring support 102 and second ring support 104, both formed of a deformable, spring-like material; and an antenna interface adapter 103 comprising a balun secured and electrically connected to the radiating element ring 101. In this embodiment, the use of a radiating element ring 101 results in a vacant area of air 105. Further, a gap 106 is introduced in the radiating element ring 101 wherein the balun is fed across the gap 106. In another embodiment illustrated in FIG. 23, a deployable antenna 110 may further comprise a collapsible membrane 111 formed of a nonconductive material wherein the perimeter of the collapsible membrane 111 is secured to a second ring support 112 (as illustrated) or to a first ring support 113 (not shown). The collapsible membrane essentially fills in the vacant area of air 105 that exists in the embodiment illustrated in FIG. 22. In still a further embodiment, the second support ring 104 may be eliminated from the embodiment illustrated in FIG. 22. In another embodiment, this structure is operated at a resonant mode that is not the lowest order, or fundamental, mode. The operating mode may be chosen to provide alternate radiation patterns or to provide an increased gain compared to the fundamental mode.

In still another embodiment of a deployable antenna, wherein the collapsible membrane also serves as a canopy for an umbrella as described above, at least one radiating element is attached to a collapsible membrane that provides the umbrella canopy (not shown). In an embodiment, the at least one radiating element is attached to a nonconductive collapsible membrane that provides the umbrella canopy, wherein the at least one radiating element is printed or etched from metal attached to a thin laminate material (not shown). In another embodiment, the at least one radiating element is attached to a conductive collapsible membrane that provides the umbrella canopy, wherein the at least one radiating element is formed of patterns of conductive fabric attached to a nonconductive fabric (not shown). In an embodiment, the at least one radiating element is a plurality of radiating wire elements attached to the collapsible membrane and arranged in a circular array (not shown). In this embodiment, a dipole may be centered at the umbrella center, or it may be offset. In the case wherein the dipole is centered at the umbrella center, opposite arms of the dipole are diametrically opposed on the umbrella canopy and a feed comes up through the center of the umbrella, along an umbrella's handle, or inside the umbrella's handle (not shown). In a second embodiment, the at least one radiating element is a plurality of radiating bow-tie dipole elements attached to the collapsible membrane and arranged in a circular array (not shown). In a third embodiment, the at least one radiating element is a plurality of radiating elements arranged in at least one "V" shape as is known in the art (not shown). In a fourth embodiment, the at least one radiating element is a plurality of radiating elements arranged in at least one "volcano" shape as is known in the art (not shown). In this embodiment, the collapsible membrane may be a plurality of layers comprising at least one layer of conductive material and at least one layer of nonconductive material. Further, in this embodiment, a slot may be cut out of the at least one layer of conductive material wherein the slot corresponds with the open area of the "volcano" shape (not shown). In an embodiment, the multiple embodiments described above further comprises a distribution network that provides power to the plurality of radiating elements, cross-members that support the collapsible membrane, or both and at least one transmission line electrically connected to the plurality of radiating elements and the distribution network (not shown). In another embodiment, the multiple embodiments described above may further comprise a weatherproof layer of nonconductive material wherein the at least one radiating element is contained between the weatherproof layer and the collapsible membrane (not shown). In the multiple embodiments described above wherein a plurality of radiating elements are arranged in a circular array, the plurality of radiating elements are excited with a sequential phasing so as to construct a radiation pattern that is circularly polarized.

In another embodiment (not shown) a deployable antenna is comprised of a collapsible membrane, a plurality of subarrays attached to the membrane in a rectilinear pattern, a plurality of transmission lines attached to the subarrays on one end of the transmission lines, and a distribution network comprised of a power divider attached to the plurality of transmission lines on the second end of the transmission lines. A sewn-in wire ring of spring-like material supports the membrane. The membrane is formed of a flexible, nonconductive fabric and collapses in a like method as illustrated in FIG. 9. Each of the plurality of subarrays may comprise a plurality of radiating elements such as dual-sided printed dipoles in a bow-tie configuration. The conductive items of the subarrays may be made of conductive fabric, conductive metal or alloy, or any combination. The subarrays are not required to conform to the membrane's concentric section in its collapsed configuration. In this particular embodiment, the transmission lines are formed of flexible circuit material or fabric so that repetitive folding does not damage the subarrays or transmission lines.

In still another embodiment (not shown), a deployable antenna is comprised of a collapsible membrane wherein the collapsible membrane is formed of a nonconductive material; at least one radiating element of the cavity antenna element-type comprised of at least one top boundary component formed of a conductive material attached to the collapsible membrane; a ring support attached to the perimeter of the collapsible membrane wherein the ring support is formed of a spring-like material; a ground plane boundary component attached to the ring support at the perimeter of the ground plane boundary component wherein the ground plane boundary component is formed of a conductive material, a collapsible dielectric spacer contained between the collapsible membrane and ground plane boundary component wherein the collapsible dielectric spacer is formed of a material with a relative dielectric constant greater than or equal to 1; at least one probe feed electrically connected to the at least one top boundary component, extending through the collapsible membrane, collapsible dielectric spacer, and ground plane boundary component, wherein the at least one probe feed is not electrically connected to the ground plane boundary component, and wherein the at least one probe feed is formed of a conductive material; and an antenna interface adapter electrically connected to the at least one probe feed. In an embodiment, the ring support is formed of a conductive, spring-like material. In a second embodiment, the ring support is formed of a nonconductive spring-like material. In an embodiment, the deployable antenna is further comprised of at least one insulating grommet attached to the ground plane boundary component wherein the at least one probe feed extends through the at least one insulating grommet such that the at least one insulating grommet ensures the at least one probe feed is not electrically connected to the ground plane boundary component. In an embodiment, the at least one top boundary component is attached to the top side of the collapsible membrane wherein the top side is the side exposed to the environment. In a second embodiment, the at least one top boundary component is attached to the bottom side of the collapsible membrane wherein the bottom side is the side not exposed to the environment. In an embodiment, the at least one top boundary component is attached to the collapsible membrane and the collapsible membrane is attached to the ground plane boundary component by a nonconductive thread in a stitching fashion. In a second embodiment, nonconductive thread is stitched through the collapsible membrane, collapsible dielectric spacer, and ground plane boundary component to prevent unwanted movement of the collapsible dielectric spacer and help maintain a constant thickness. In an embodiment, the at least one top boundary component is an annular ring. In a second embodiment, the at least one top boundary component is an array. In an embodiment, the deployable antenna further comprises a distribution network attached to the at least one top boundary component and electrically connected to the at least one probe feed wherein the at least one probe feed is one probe feed. In another embodiment, the collapsible dielectric spacer is comprised of a first and second spacer layer and the deployable antenna further comprises a capacitive feed formed of a conductive fabric contained between the first and second spacer layer and wherein the at least one feed probe is electrically connected to the capacitive feed. In yet another embodiment, all elements and combination of elements described above remain the same with the following exceptions: the collapsible membrane is formed of a conductive fabric, the at least one top boundary component is comprised of at least one radiating slot cut out of the collapsible membrane, and the at least one probe feed is electrically connected to the collapsible membrane.

Multiple methods exist for operating a deployable antenna. For example, a method of operating a deployable antenna in combination with a mobile communication system may comprise the following steps in no particular order. Attach at least one radiating element, parasitic element, subarray, or radiating means to a collapsible membrane to form the deployable antenna. Attach at least one transmission line to the collapsible membrane and electrically connect each transmission line to each radiating element, subarray, or radiating means on one end of each transmission line. Attach at least one distribution network to the collapsible membrane and electrically connect each distribution network to at least one transmission line on the at least one transmission line's second end. Attach the antenna interface adapter to the other end of the distribution network. Collapse the deployable antenna in a reduced volume configuration. Stow the deployable antenna in its reduced volume configuration. Unstow the deployable antenna in its reduced volume configuration. Expand the deployable antenna to fully deployed configuration. Electrically connect the antenna interface adapter of the deployable antenna to the mobile communications system. Position and orient the deployable antenna to maximize the received signal strength, or point the boresight of the deployable antenna towards a known relay station or communication hub.

While the invention has been described with particular embodiments, it will be understood by those skilled in the art that various changes may be made and equivalent elements may be substituted for elements thereof with departing from the scope of the invention. In addition, modifications may be made to adapt a particular situation to the teachings of the present invention without departing from the essential scope thereof. Therefore, it is intended that the invention not be limited to any particular embodiment disclosed as the best mode contemplated for carrying out the invention, but that the invention will include all embodiments falling within the scope of claims.

What is claimed is:

1. An antenna comprising:

a collapsible membrane having at least one radiating slot for transmitting electromagnetic waves, receiving electromagnetic waves, or both; and a ring support formed of a deformable material attached to the perimeter of the collapsible membrane, wherein the ring support is capable of collapsing by twisting opposing ends of the ring support in opposite screw senses while simultaneously bringing the opposing ends toward each other and forming a predetermined number of interleaved concentric sections.

2. The antenna according to claim 1, wherein the collapsible membrane is formed of at least one layer of conductive material attached to at least one layer of nonconductive material and wherein the at least one radiating slot is excised from the at least one layer of conductive material.

3. The antenna according to claim 1, further comprising:

at least one fastener of nonconductive material and of predetermined length wherein one end of the at least one fastener is attached to the collapsible membrane; and a reflector attached to the second end of the at least one fastener wherein the reflector is generally parallel to the at least one radiating slot and spaced at a predetermined distance from the at least one radiating slot.

4. The antenna according to claim 1, wherein the collapsible membrane is formed of a flexible, conductive material and further comprising:

a ground plane boundary component attached to the ring support at the perimeter of the ground plane boundary component and wherein the ground plane boundary component is collapsible and formed of a flexible, conductive material; and a collapsible dielectric spacer contained between the collapsible membrane and the ground plane boundary component wherein the collapsible dielectric spacer is formed of a material with a relative dielectric constant greater than or equal to 1.

5. The antenna according to claim 4, further comprising an antenna interface adapter electrically connected to the at least one radiating slot, wherein the antenna interface adapter comprises at least one balun.

6. The antenna according to claim 4, further comprising:

a probe electrically connected to the ground plane component on the probe's first end, wherein the probe loops back and passes through the ground plane component but is insulated from the ground plane component by a non-conductive grommet to prevent electrical connectivity at a second point; and an antenna interface adapter electrically connected to the ground plane component and to the probe on the probe's second end.

7. An antenna comprising:

at least one collapsible membrane;

a ring support formed of a deformable material attached to the perimeter of the at least one collapsible membrane, wherein the ring support is capable of collapsing by twisting opposing ends of the ring support in opposite screw senses while simultaneously bringing the opposing ends toward each other and forming a predetermined number of interleaved concentric sections; and at least one radiating element attached to one of the at least one collapsible membrane for transmitting electromagnetic waves, receiving electromagnetic waves, or both.

8. The antenna according to claim 7, wherein the at least one collapsible membrane is formed of a flexible, nonconductive material and the at least one radiating element is formed of a conductive fabric.

9. The antenna according to claim 7, wherein the at least one radiating element is comprised of a ground plane wherein the ground plane is attached to one of the at least one collapsible membrane, a substrate wherein the substrate is attached to the ground plane, a feed network wherein the feed network is attached to the substrate, and a radiating component wherein the radiating component is attached to the substrate and electrically connected to the feed network.

10. The antenna according to claim 7, wherein one of the at least one collapsible membrane is a ground plane and the at least one radiating element is comprised of a substrate wherein the substrate is attached to the collapsible membrane, a feed network wherein the feed network is attached to the substrate, and a radiating component wherein the radiating component is attached to the substrate and electrically connected to the feed network.

11. The antenna according to claim 7, wherein the at least one radiating element is a plurality of radiating elements and further comprising:

at least one transmission line electrically connected to the plurality of radiating elements; and at least one distribution network electrically connected to the at least one transmission line.

12. The antenna according to claim 11, further comprising at least one power source electrically connected to the at least one distribution network.

13. The antenna according to claim 11, further comprising:

at least one power distribution subsystem electrically connected to the at least one distribution network; and at least one power source electrically connected to the at least one power distribution subsystem.

14. The antenna according to claim 7, further comprising at least one transmission line electrically connected to the at least one radiating element and an antenna interface adapter electrically connected to the at least one transmission line.

15. The antenna according to claim 14, further comprising:

at least one fastener of nonconductive material and of predetermined length wherein one end of the at least one fastener is attached to the at least one collapsible membrane; and a reflector attached to the second end of the at least one fastener wherein the reflector is generally parallel to the at least one radiating element and spaced at a predetermined distance from the at least one radiating element.

16. The antenna according to claim 7, further comprising a support means for supporting the at least one collapsible membrane at a predetermined angle relative to a surface.

17. The antenna according to claim 7, further comprising a container for temporarily storing the at least one collapsible membrane.

18. An antenna comprising:

a collapsible membrane;

a ring support formed of a deformable material attached to the perimeter of the collapsible membrane, wherein the ring support is capable of collapsing by twisting opposing ends of the ring support in opposite screw senses while simultaneously bringing the opposing ends toward each other and forming a predetermined number of interleaved concentric sections; and at least one radiating means for transmitting electromagnetic waves, receiving electromagnetic waves, or both attached to the collapsible membrane by an attachment means for attaching the radiating means to the collapsible membrane.

19. The antenna according to claim 18, further comprising at least one transmission line attached to the collapsible membrane by a transmission line attachment means for attaching the transmission line to the collapsible membrane.

20. The antenna according to claim 18, further comprising at least one transmission network attached to the collapsible membrane by a transmission network attachment means for attaching the transmission network to the collapsible membrane.

21. An antenna comprising:

a collapsible membrane of deformable, nonconductive material wherein the collapsible membrane is collapsible into a plurality of sections;

a ring support formed of a deformable material attached to the perimeter of the collapsible membrane, wherein the ring support is capable of collapsing by twisting opposing ends of the ring support in opposite screw senses while simultaneously bringing the opposing ends toward each other and forming a predetermined number of interleaved concentric sections; and at least one array antenna attached to the collapsible membrane for transmitting electromagnetic waves, receiving electromagnetic waves, or both.

22. The antenna according to claim 21, wherein the at least one array antenna is comprised of a plurality of radiating elements, a plurality of subarrays, or both.

23. The antenna according to claim 21, wherein the collapsible membrane is formed of at least one layer of conductive material attached to at least one layer of nonconductive material and the at least one array antenna is formed of a plurality of radiating slots excised out of the at least one layer of conductive material.

24. The antenna according to claim 21, wherein the at least one array antenna is a traveling wave antenna.

25. The antenna according to claim 21, wherein the at least one array antenna is a plurality of array antennas and wherein the plurality of array antennas is attached to one of the plurality of sections.

26. The antenna according to claim 21, wherein the at least one array antenna is comprised of a plurality of radiating elements and wherein the plurality of radiating elements is attached to one of the plurality of sections.

27. The antenna according to claim 21, wherein the at least one array antenna is comprised of a plurality of radiating elements, wherein the number of sections is equivalent to the number of radiating elements, and wherein the plurality of sections has one radiating element attached thereto.

28. The antenna according to claim 21, further comprising:

a plurality of fasteners formed of nonconductive material and of predetermined length wherein one end of the plurality of fasteners is attached to the collapsible membrane; and a reflector attached to the second end of the plurality of fasteners wherein the reflector is generally parallel to the at least one array antenna and spaced at a predetermined distance from the at least one array antenna.

29. The antenna according to claim 21, further comprising:

at least one transmission line electrically connected on one end to the at least one array antenna; and at least one distribution network electrically connected to the second end of the at least one transmission line.

30. The antenna according to claim 29, wherein the at least one transmission line is selected from a group consisting of a coaxial line, a slotline, a stripline, a microstrip, and a twin coupled line.

31. The antenna according to claim 29, wherein the distribution network is selected from a group consisting of a power divider, power combiner, a filter, a phase shifter, and a low noise amplifier.

32. The antenna according to claim 29, further comprising a support means for supporting the collapsible membrane at a predetermined angle relative to a surface wherein the support means is attached to the collapsible membrane.

33. The antenna according to claim 21, wherein the ring support is formed of a nonconductive, deformable material.

34. The antenna according to claim 33, wherein the nonconductive, deformable, spring-like material is selected from a group consisting of fiberglass, carbon, and carbon-glass composites.

35. The antenna according to claim 29, further comprising:

a plurality of fasteners of nonconductive material and of predetermined length wherein one end of the plurality of fasteners is attached to the collapsible membrane; and a reflector attached to the second end of the plurality of fasteners wherein the reflector is generally parallel to the at least one array antenna and spaced at a predetermined distance from the at least one array antenna.

36. An antenna comprising:

a first collapsible membrane of deformable, nonconductive material wherein the first collapsible membrane is collapsible into a plurality of sections;

a first ring support formed of a deformable material secured to the perimeter of the first collapsible membrane, wherein the first ring support is capable of collapsing by twisting opposing ends of the first ring support in opposite screw senses while simultaneously bringing the opposing ends toward each other and forming a predetermined number of interleaved concentric sections; and at least one radiating means for transmitting electromagnetic waves, receiving electromagnetic waves, or both wherein the at least one radiating means is attached to the first collapsible membrane.

37. The antenna according to claim 36, wherein the at least one radiating means function to guide a traveling wave as in a traveling wave antenna.

38. The antenna according to claim 37, wherein the at least one radiating means is arranged in a generally parallel and longitudinal manner relative to the principal direction of radiation.

39. The antenna according to claim 38, wherein the at least one radiating means is two elongated boundary components arranged in the shape of a "V".

40. The claim according to 39, further comprising:

a plurality of second collapsible membranes secured to the first collapsible membrane wherein the plurality of second collapsible membranes are formed of a deformable, conductive material;

a plurality of second ring supports secured to the perimeter of the plurality of second collapsible membranes and wherein the plurality of second ring supports are formed of a second deformable material, wherein the second ring support is capable of collapsing by twisting opposing ends of the second ring support in opposite screw senses while simultaneously bringing the opposing ends toward each other and forming a predetermined number of interleaved concentric sections; and a third ring support surrounding the collapsible membrane and the plurality of second collapsible membranes and wherein the third ring support is formed of a nonconductive, deformable material, wherein the third ring support is capable of collapsing by twisting opposing ends of the third ring support in opposite screw senses while simultaneously bringing the opposing ends toward each other and forming a predetermined number of interleaved concentric sections.

41. The claim according to 39, wherein the open ends of the two elongated boundary components in the shape of a "V" are connected with an elongated resistance, wherein the resistance is formed of a fabric with a predetermined conductivity.

42. The antenna according to claim 38, further comprising:

a backedge formed of a conductive material attached to the first collapsible membrane.

43. The antenna according to claim 37, further comprising at least one parasitic element, wherein the at least one radiating means is at least one driven element, and wherein the at least one driven element and at least one parasitic element are arranged in an orthogonal manner relative to the principal direction of radiation.

44. The antenna according to claim 43, further comprising:

a backedge formed of a conductive material attached to the first collapsible membrane;

at least one balun electrically connected to the at least one driven element and attached to the first collapsible membrane;

at least one transmission line electrically connected to the at least one balun and attached to the first collapsible membrane; and at least one antenna interface adapter electrically connected to the at least one transmission line and attached to the first collapsible membrane.

45. The antenna according to claim 36, wherein the deformable, nonconductive material is selected from a group consisting of fabric, plastic, and paper.

46. The antenna according to claim 36, further comprising:

at least one distribution network attached to the first collapsible membrane; and at least one transmission line wherein the at least one transmission line is attached to one radiating means on one end and to one distribution network on the second end.

47. The antenna according to claim 36, further comprising a support means for supporting the first collapsible membrane at a predetermined angle relative to a surface wherein the support means is attached to the collapsible membrane.

48. The antenna according to claim 36, further comprising:

a plurality of fasteners of nonconductive material and of predetermined length wherein one end of the plurality of fasteners is attached on one end to the first collapsible membrane; and a reflector attached to the second end of the plurality of fasteners wherein the reflector is generally parallel to the at least one radiating means and spaced at a predetermined distance from the at least one radiating means.

49. The claim according to 39, further comprising:

a plurality of second collapsible membranes secured to the first collapsible membrane wherein the plurality of second collapsible membranes are formed of a deformable, conductive material; and a plurality of second ring supports secured to the perimeter of the plurality of second collapsible membranes and wherein the plurality of second ring supports are formed of a second deformable material, wherein each second ring support is capable of collapsing by twisting opposing ends of each second ring support in opposite screw senses while simultaneously bringing the opposing ends toward each other and forming a predetermined number of interleaved concentric sections.

50. An antenna comprising:

a ring support formed of a conductive, deformable material, wherein the ring support is capable of collapsing by twisting opposing ends of the ring support in opposite screw senses while simultaneously bringing the opposing ends toward each other and forming a predetermined number of interleaved concentric sections;

a collapsible membrane secured at its perimeter to the ring support wherein the collapsible membrane is formed of a nonconductive material; and an antenna interface adapter electrically connected to the ring support.

51. An antenna comprising:

a first ring support formed of a deformable material, wherein the first ring support is capable of collapsing by twisting opposing ends of the first ring support in opposite screw senses while simultaneously bringing the opposing ends toward each other and forming a predetermined number of interleaved concentric sections;

a radiating element ring secured to the first ring support at the radiating element ring's outside perimeter wherein the at least radiating element ring is collapsible, forming a vacant area of air that shares a common center with the first ring support, and forming a gap such that the radiating element ring does not complete a full circle; and an antenna interface adapter electrically connected to the radiating element ring.

52. The antenna according to claim 51, further comprising a collapsible membrane secured to the antenna wherein the collapsible membrane is formed of a nonconductive material and fills in the vacant area of air.

53. The antenna according to claim 51, further comprising a second ring support secured to the inside perimeter of the radiating element ring wherein the second ring support is formed of a second deformable material, wherein the second ring support is capable of collapsing by twisting opposing ends of the second ring support in opposite screw senses while simultaneously bringing the opposing ends toward each other and forming a predetermined number of interleaved concentric sections.

54. An antenna comprising:

at least one boundary component comprised of at least one collapsible membrane formed of a flexible, conductive material;

a first ring support attached to the at least one boundary component wherein the first ring support is formed of a first deformable material, wherein the first ring support is capable of collapsing by twisting opposing ends of the first ring support in opposite screw senses while simultaneously bringing the opposing ends toward each other and forming a predetermined number of interleaved concentric sections;

a second ring support attached to the at least one boundary component and coupled to the first ring support in such as way as to allow folding the first and second ring supports with respect to each other, thus forming a wedge, and wherein the second ring support is formed of a second deformable material, wherein the second ring support is capable of collapsing by twisting opposing ends of the second ring support in opposite screw senses while simultaneously bringing the opposing ends toward each other and forming a predetermined number of interleaved concentric sections;

a feed probe electrically connected on the feed probe's first end to the at least one boundary component inside either the perimeter of the first or second ring supports and passing through the perimeter of the second ring support; and an antenna interface adapter electrically connected to the feed probe's second end.

55. The antenna according to claim 54, further comprising a prop attached to the antenna in such a manner as to sustain a wedge relative to the first and second ring supports wherein the prop is formed of a semi-rigid or rigid, nonconductive material.

56. The antenna according to claim 54, further comprising at least one side boundary component electrically connected to the at least one boundary component in such as manner as to alter the input impedance of the antenna or increase the directivity of the antenna in its deployed state.

57. The antenna according to claim 54, wherein the feed probe, passes through the perimeter of the second ring support, loops back and is electrically connected to the at least one boundary component inside the perimeter of the second ring support on the feed probe's first end and wherein the feed probe is not directly connected to the at least one boundary component inside the perimeter of the first ring support.

58. The antenna according to claim 54, wherein the at least one boundary component is comprised of:

a first boundary component attached at its perimeter to the first ring support and wherein the first boundary component is comprised of a first collapsible membrane formed of a flexible, conductive material;

a second boundary component attached at its perimeter to the second ring support and coupled to the first boundary component wherein the second boundary component is comprised of a second collapsible membrane formed of a flexible, conductive material;

and wherein the feed probe is electrically connected on the feed probe's first end to either the first boundary component or second boundary component and passing through the second boundary component.

59. The antenna according to claim 58, wherein the feed probe is electrically connected to the first boundary component on the feed probe's first end and wherein the feed probe is not directly connected to the second boundary component.

60. The antenna according to claim 58, wherein the feed probe is a loop-type feed, passes through the second boundary component, loops back and is electrically connected to the second boundary component on the feed probe's first end and wherein the feed probe is not directly connected to the first boundary component.

61. An antenna comprising:

a first collapsible membrane formed of a flexible, nonconductive material;

a ring support attached to the perimeter of the first collapsible membrane wherein the ring support is formed of a deformable material, wherein the ring support is capable of collapsing by twisting opposing ends of the ring support in opposite screw senses while simultaneously bringing the opposing ends toward each other and forming a predetermined number of interleaved concentric sections;

at least one top boundary component formed of flexible conductive material, flexible non-conductive material, or both supported by the first collapsible membrane;

a ground plane boundary component attached to the ring support at the perimeter of the ground plane boundary component wherein the ground plane boundary component is formed of a flexible, conductive material;

a collapsible dielectric spacer contained between the first collapsible membrane and the ground plane boundary component wherein the collapsible dielectric spacer is formed of a material with a relative dielectric constant greater than or equal to 1, at least one probe feed electrically connected to the at least one top boundary component, wherein the at least one probe feed extends through the collapsible membrane, collapsible dielectric spacer, and ground plane boundary component, wherein the at least one probe feed is not electrically connected to the ground plane boundary component, and wherein the at least one probe feed is formed of a conductive material; and an antenna interface adapter electrically connected to the at least one probe feed and the ground plane boundary component.

62. The antenna according to claim 61, wherein the collapsible dielectric spacer is comprised of a first and second spacer layer and further comprised of a capacitive feed contained between the first and second spacer layer and electrically connected to the at least one probe feed and wherein the capacitive feed is formed of a conductive material.

63. The antenna according to claim 61, wherein the at least one top boundary component is an array and further comprised of a distribution network attached to the collapsible membrane and electrically connected to the at least one probe feed and array.

64. An antenna comprising:

a collapsible membrane of deformable, nonconductive material wherein the collapsible membrane is collapsible into a plurality of sections;

at least one array antenna attached to the collapsible membrane for transmitting electromagnetic waves, receiving electromagnetic waves, or both;

a plurality of fasteners formed of nonconductive material and of predetermined length wherein one end of the plurality of fasteners is attached to the collapsible membrane; and a reflector attached to the second end of the plurality of fasteners wherein the reflector is generally parallel to the at least one array antenna and spaced at a predetermined distance from the at least one array antenna.

65. An antenna comprising:

at least one collapsible membrane formed of a flexible material;

a first ring support attached to the at least one collapsible membrane wherein the first ring support is formed of a deformable material, wherein the first ring support is capable of collapsing by twisting opposing ends of the first ring support in opposite screw senses while simultaneously bringing the opposing ends toward each other and forming a predetermined number of interleaved concentric sections;

a second ring support attached to the at least one collapsible membrane and coupled to the first ring support in such as way as to allow folding the first and second ring supports with respect to each other, thus forming a wedge, and wherein the second ring support is formed of a deformable material, wherein the second ring support is capable of collapsing by twisting opposing ends of the second ring support in opposite screw senses while simultaneously bringing the opposing ends toward each other and forming a predetermined number of interleaved concentric sections;

at least one boundary component attached to the at least one collapsible membrane;

a feed probe electrically connected on the feed probe's first end to the at least one boundary component inside either the perimeter of the first or second ring supports and passing through the perimeter of the second ring support; and an antenna interface adapter electrically connected to the feed probe's second end.

* * * * *